US005960728A

United States Patent [19]

Hirose

[11] Patent Number: 5,960,728

[45] Date of Patent: Oct. 5, 1999

[54] ROTARY HOOK FOR SEWING MACHINES

[75] Inventor: Tokuzo Hirose, Osaka, Japan

[73] Assignee: Hirose Manufacturing Co., Ltd., Osaka, Japan

[21] Appl. No.: 09/015,625

[22] Filed: Jan. 29, 1998

[30] Foreign Application Priority Data

Jan. 29, 1997 [JP] Japan ..... 9-031313
Apr. 15, 1997 [JP] Japan ..... 9-097732

[51] Int. Cl.[6] ..... D05B 57/14; D05B 57/26

[52] U.S. Cl. ..... 112/231

[58] Field of Search ..... 112/231, 228, 112/181, 184, 230

[56] References Cited

U.S. PATENT DOCUMENTS

| | | | |
|---|---|---|---|
| 388,323 | 8/1888 | Vannett | 112/231 |
| 2,990,794 | 7/1961 | Ketterer . | |
| 3,120,204 | 2/1964 | Ketterer . | |
| 4,884,520 | 12/1989 | Shimizu | 112/231 |
| 5,109,783 | 5/1992 | Shimizu . | |

FOREIGN PATENT DOCUMENTS

| | | |
|---|---|---|
| 374655 | 6/1907 | France . |
| 167445 | 1/1906 | Germany . |
| 166 274 | 8/1991 | Taiwan . |
| 217 043 | 12/1993 | Taiwan . |

*Primary Examiner*—Peter Nerbun
*Attorney, Agent, or Firm*—Wenderoth, Lind & Ponack, L.L.P.

[57] ABSTRACT

A bobbin which is housed in a bobbin case holder is held, as it is elastically pressed by a peripheral wall of a bobbin case. Passing through a gap which is created between an outermost portion of a flange of the bobbin which is disposed on an open end side of the bobbin case holder and an inner peripheral surface of the peripheral wall of the bobbin case and between the flange of the bobbin which is disposed on the open end side of the bobbin case holder and the inner surface of an end wall of the bobbin case, a bobbin thread which is wound around the bobbin is led outside through the bobbin thread leading hole which is formed in the end wall of the bobbin case. When the bobbin thread is led out as sewing is started, since the bobbin is held as it is elastically pressed by the peripheral wall of the bobbin case within the bobbin case holder, tension force of the bobbin thread prevents the bobbin from getting displaced within the bobbin case holder in an axial line direction, and hence, an inconvenience that the tension force of the bobbin thread varies is avoided, nonuniform fastening of the thread does not result, and the quality of sewing is improved.

4 Claims, 15 Drawing Sheets

ROTARY HOOK FOR SEWING MACHINES

BACKGROUND OF THE INVENTION

1. Field of the Invention

The present invention relates to a structure for holding a bobbin around which a bobbin thread is wound within a bobbin case holder of a horizontal axis full rotary hook.

2. Description of the Related Art

FIG. 1 is an exploded perspective view showing an overall structure of a typical horizontal axis full rotary hook 22 according to a conventional technique, and FIG. 2 is a partial horizontal cross sectional view showing a bobbin 2 as it is held in a bobbin case holder 3 by means of a bobbin case 1. The bobbin case holder 3 is housed in a hook body 4, which is driven to rotate about a horizontal rotation axis line L, in such a manner that the bobbin case holder is prevented from rotating. The bobbin case 1 is detachably attached to the bobbin case holder 3, and the bobbin case 1 houses the bobbin 2 around which a bobbin thread 5 is wound.

The bobbin case 1 comprises a peripheral wall 6 which is shaped approximately in the form of a letter "C" to open at the top in FIG. 1, an end wall 7 which closes one end portion of the peripheral wall 6 in the direction of the axial line, a latch 8 which is attached to the end wall 7 for free sliding in an engagement direction A1 which is along a diametral line and in a release direction A2 which is opposite to the engagement direction A1, and a manipulation flap 9 which is disposed to displace the latch 8 in the direction of the diametral line. The latch 8 is pressed by spring force by a spring not shown in the engagement direction A1. A bobbin thread tension spring 10 is disposed to the peripheral wall 6 of the bobbin case 1. As indicated by an imaginary line 5*a,* the bobbin thread 5 of the bobbin 2 which is housed in the bobbin case 1 is led out through a gap between the peripheral wall 6 and the bobbin thread tension spring 10 so that it is possible to apply tension force to the bobbin thread 5.

The bobbin 2 which is housed in the bobbin case 1 comprises a pair of flanges 11*a,* 11*b,* and a winding drum 12 which is shaped as a right circular cylinder and which links the flanges 11*a,* 11*b.* The bobbin case holder 3 includes a peripheral wall 13, a bottom portion 14 which extends in the direction of the diametral line at an end portion of the peripheral wall 13 taken in an axial line direction, and a stud 15 which is disposed to the bottom portion 14 upright toward an open end side. A ring-shaped engagement recess 16 is formed in an idle end portion of the stud 15.

A cylinder portion 17 which is shaped as a right circular cylinder is formed to the end wall 7 of the bobbin case 1, to extend along an axial line of the peripheral wall 6 toward the open end side of the peripheral wall 6. The stud 15 is inserted as it is mounted to the bobbin case holder 3 in the cylinder portion 17, so that the stud 15 projects outside from a central hole 18 which is formed in the end wall 7, passes through a first through hole 19 which is formed in the latch 8, and is exposed outside as the bobbin case 1 is partially received by a second through hole 20 which is formed in the manipulation flap 9.

Thus, when the bobbin case 1 is mounted to the bobbin case holder 3, a peripheral portion 21 which is faced with the first through hole 19 of the latch 8 is engaged with the engagement recess 16 of the stud 15, whereby the bobbin case holder 3 and the bobbin case 1 engage with each other and the bobbin case 1 is locked from falling by the bobbin case holder 3. The bobbin 2 is housed in the bobbin case 1, with the cylinder portion 17 of the bobbin case 1 passing through the winding drum 12 of the bobbin 2. As described earlier, the bobbin thread 5 of the bobbin 2 is led out through the gap between the bobbin thread tension spring 10 and the peripheral wall 6 as indicated by the imaginary line 5*a,* so that it is possible to sew with predetermined tension force.

In the conventional technique as described above, as described earlier, when the bobbin 2 is held within the bobbin case holder 3 by means of the bobbin case 1, the stud 15 of the bobbin case holder 3 is inserted in the cylinder portion 17 of the bobbin case 1, the cylinder portion 17 is inserted in the winding drum 12 of the bobbin 2 and the bobbin 2 is supported for free rotation about a rotation axis line which is approximately coaxial with the axial line of the cylinder portion 17. In this condition, since a small gap T of about 0.2 to 0.5 mm which allows the bobbin 2 to rotate is created between the flange 11*a,* which is disposed on the bottom portion 14 side of the bobbin case holder 3 of the bobbin 2 (i.e., the left-hand side in FIG. 2), and the bottom portion 14 or between the other flange 11*b,* which is disposed on the open end 21 side of the bobbin case holder 3 of the bobbin 2 (i.e., the right-hand side in FIG. 2), and the end wall 7 of the bobbin case 1, during sewing, due to tension force of the bobbin thread 5 which is led outside from the bobbin case 1, the bobbin 2 is displaced in the range of the gap T in the axial line direction while rotating. The displacement causes the tension force of the bobbin thread 5 to vary. As a result, the thread is fastened nonuniformly, whereby the quality of sewing is deteriorated.

Further, with respect to the conventional rotary hook 22 as above, an increase in the amount of the bobbin thread which is wound up around the winding drum 12 of the bobbin 2 may be realized by modifying the structure, e.g., by extending the length H of the winding opening of the bobbin 2 toward the open end of the bobbin case holder 3 or the bottom portion 14 and reducing the diameter D of the winding drum 12. However, when the bobbin 2 is extended toward the open end of the bobbin case holder 3 and the length H of the winding drum 12 of the bobbin 2 is increased, in a path in which a needle 23 moves, the tip of the needle hits a flange 11*b* or the bobbin thread 5 which is wound around the winding drum 12.

Still further, when the bottom portion 14 of the bobbin case holder 3 is extended toward the hook body 4 and the length H of the winding drum 12 of the bobbin 2 is extended toward the bottom portion 14 of the bobbin case holder 3, the length of the bobbin case holder 3 taken in the axial direction becomes long. In such a structure, a needle thread gets caught by the bottom portion 14 of the bobbin case holder 3, and therefore, the thread can not get through.

On the other hand, when the diameter D of the winding drum 12 is reduced, since the cylinder portion 17 of the bobbin case 1 and the stud 15 of the bobbin case holder 3 are inserted within the winding drum 12, since the diameter D of the winding drum 12 is restricted, it is difficult to reduce the diameter D of the winding drum 12.

SUMMARY OF THE INVENTION

An object of the invention is to provide a rotary hook for sewing machines capable of preventing nonuniform thread fastening by stabilizing tension force of a bobbin thread to improve the quality of sewing.

Another object of the invention is to provide a horizontal axis full rotary hook capable of preventing nonuniform thread fastening by stabilizing tension force of a bobbin thread to improve the quality of sewing and increase the amount of the bobbin thread.

In a first aspect of the invention a rotary hook for sewing machines comprises a bobbin case holder, a bobbin case detachably attached to the bobbin case holder, a bobbin which is held in the bobbin case holder by elastically pressing a flange of the bobbin disposed on a bottom portion side of the bobbin case holder, against a peripheral wall of the bobbin case, wherein a gap through which a bobbin thread wound around the bobbin passes is provided between an outermost portion of a flange of the bobbin disposed on an open end side of the bobbin case holder and an inner peripheral surface of the peripheral wall of the bobbin case and between the flange of the bobbin disposed on the open end side of the bobbin case holder and an inner surface of an end wall of the bobbin case, and a bobbin thread leading hole linked to the gap is formed in the end wall of the bobbin case.

According to the invention, the bobbin which is housed in the bobbin case holder is held, as it is elastically pressed by the peripheral wall of the bobbin case. Passing through the gap which is created between the outermost portion of the flange of the bobbin which is disposed on the open end side of the bobbin case holder and the inner peripheral surface of the peripheral wall of the bobbin case and between the flange of the bobbin which is disposed on the open end side of the bobbin case holder and the inner surface of the end wall of the bobbin case, the bobbin thread which is wound around the bobbin is led outside through the bobbin thread leading hole which is formed in the end wall of the bobbin case. When the bobbin thread is led out as sewing is started, since the bobbin is held as it is elastically pressed by the peripheral wall of the bobbin case within the bobbin case holder, tension force of the bobbin thread prevents the bobbin from getting displaced within the bobbin case holder in an axial line direction, and hence, an inconvenience that the tension force of the bobbin thread varies is avoided, nonuniform fastening of the thread does not result, and the quality of sewing is improved.

Further, since the gap which the bobbin thread can pass through is created between the bobbin and the bobbin case, the bobbin thread smoothly rotates on an outer peripheral portion of the flange and gets unwound as it is tensed from the bobbin thread leading hole down to the outer peripheral portion of the flange which is disposed on the open end side. Since rotation of the bobbin due to leading out of the bobbin thread is prevented in this manner, it is possible to prevent a problem that the bobbin thread is loosened within the bobbin case and gets tangled and entangled despite while inertial rotation of the bobbin stops sewing. In addition, since the bobbin is elastically pressed by the peripheral wall of the bobbin case within the bobbin case holder, when large tension force is created by the tensed bobbin thread or the like, displacement of the bobbin within the bobbin case holder is possible against the elastic pressing force toward the open end side, and therefore, it is possible to avoid cutting of the bobbin thread and prevent inconvenient interruption of sewing for passing the bobbin thread through the predetermined path.

In a second aspect of the invention a spring for elastically pressing the bobbin within the bobbin case holder toward the open end side of the bobbin case holder is disposed at a bottom portion of the bobbin case holder.

According to the invention, since the spring is disposed to the bottom portion of the bobbin case holder, the bobbin which is held within the bobbin case holder is supported by the peripheral wall of the bobbin case, as it is elastically pressed by the peripheral wall toward the open end side of the bobbin case holder. This eliminates the necessity to press the bobbin which is held within the bobbin case holder by means of large elastic pressing force of the peripheral wall of the bobbin case, and hence, the necessity to increase the spring force which gives the elastically pressing force and adjust the structure of the bobbin case and an engagement portion of the bobbin case holder so that the peripheral wall of the bobbin case applies proper elastic pressing force to the bobbin, whereby labor of manufacturing is reduced.

In a third aspect of the invention, an axial line of the bobbin case holder is inclined with respect to a rotation axial line of the hook body, in a direction in which an idle end portion of the bobbin which is closest to a needle is farther with distance from a path in which the needle moves.

According to the invention, since the axial line of the bobbin case holder is inclined with respect to the rotation axial line of the hook body in the direction in which the idle end portion of the bobbin which is closest the needle is farther with distance from the path in which the needle moves, a winding drum of the bobbin which is held in the bobbin case holder can be extended toward the open end side of the bobbin case holder while preventing the tip of the needle from abutting against the flange which is disposed on the open end side of the bobbin case holder nor the bobbin thread which is wound around the winding drum. This makes it possible to increase the amount of the bobbin thread which is wound around the winding drum of the bobbin. Further, according to the invention, unlike in the conventional technique described earlier, the bobbin is not structured to be supported by a stud of the bobbin case holder, and therefore, neither a cylinder portion of the bobbin case nor the stud of the bobbin case holder is inserted in the winding drum of the bobbin. This enables to reduce the diameter of the winding drum, and hence, further increase the amount of the bobbin thread.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
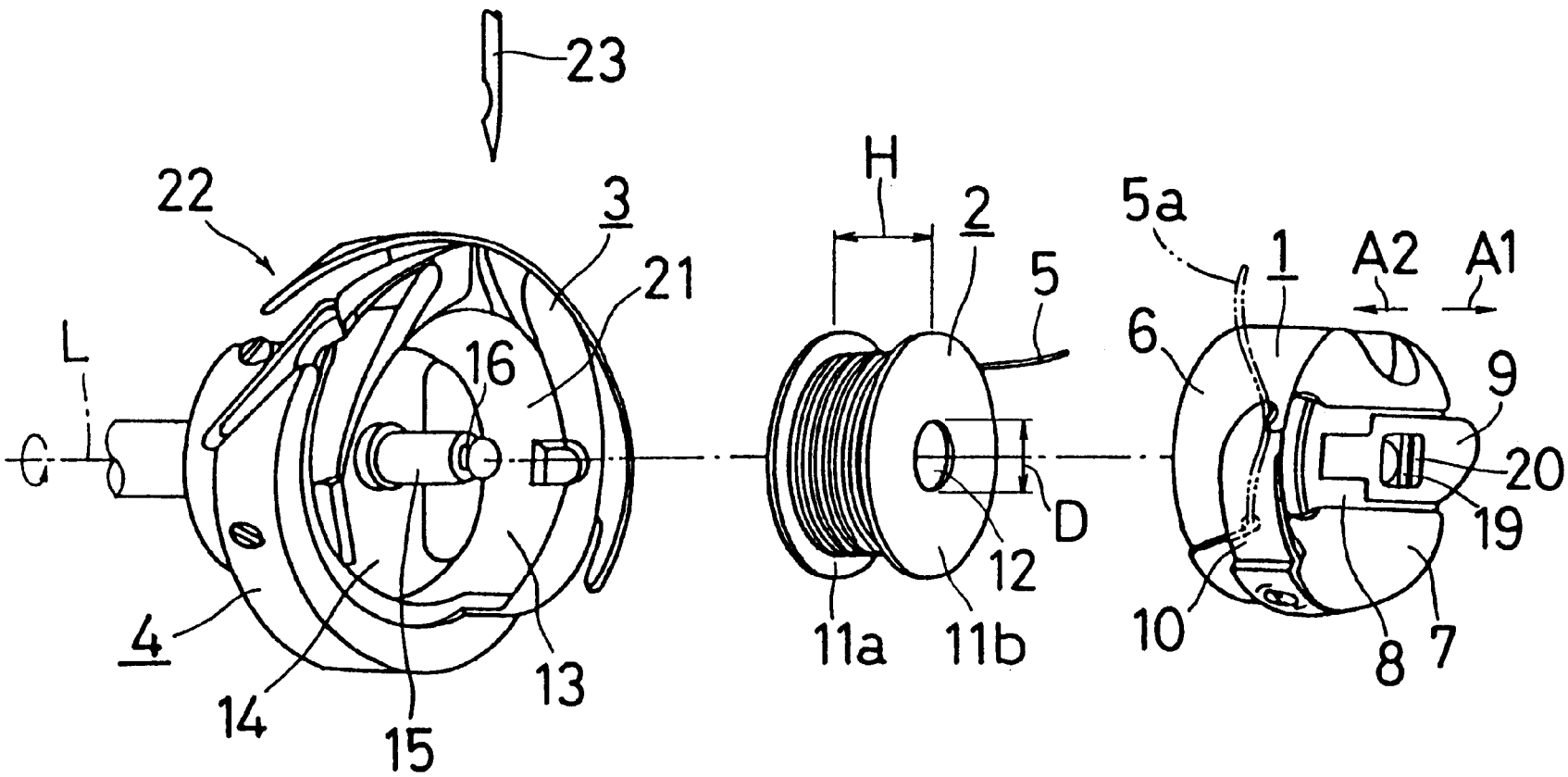
FIG.1 PRIOR ART
FIG. 1 is an exploded perspective view of a horizontal axis full rotary hook 22 according to a typical conventional technique.

Now referring to the drawings, preferred embodiments of the invention are described below.

Figure 3:
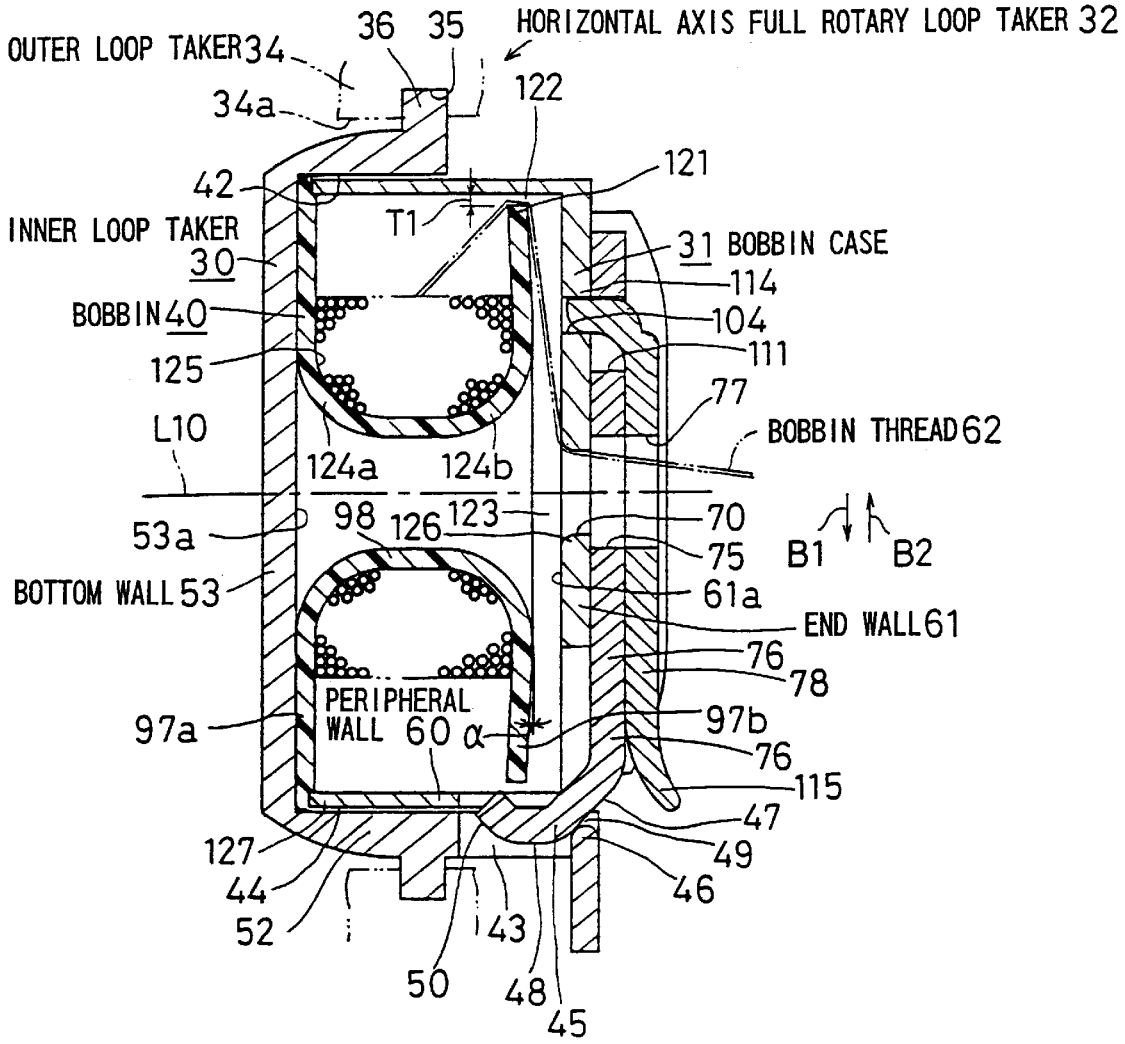
FIG. 3 is a horizontal cross sectional view of a portion of a horizontal axis full rotary hook 32 according to a preferred embodiment of the invention as it is seen from below.
Figure 4:
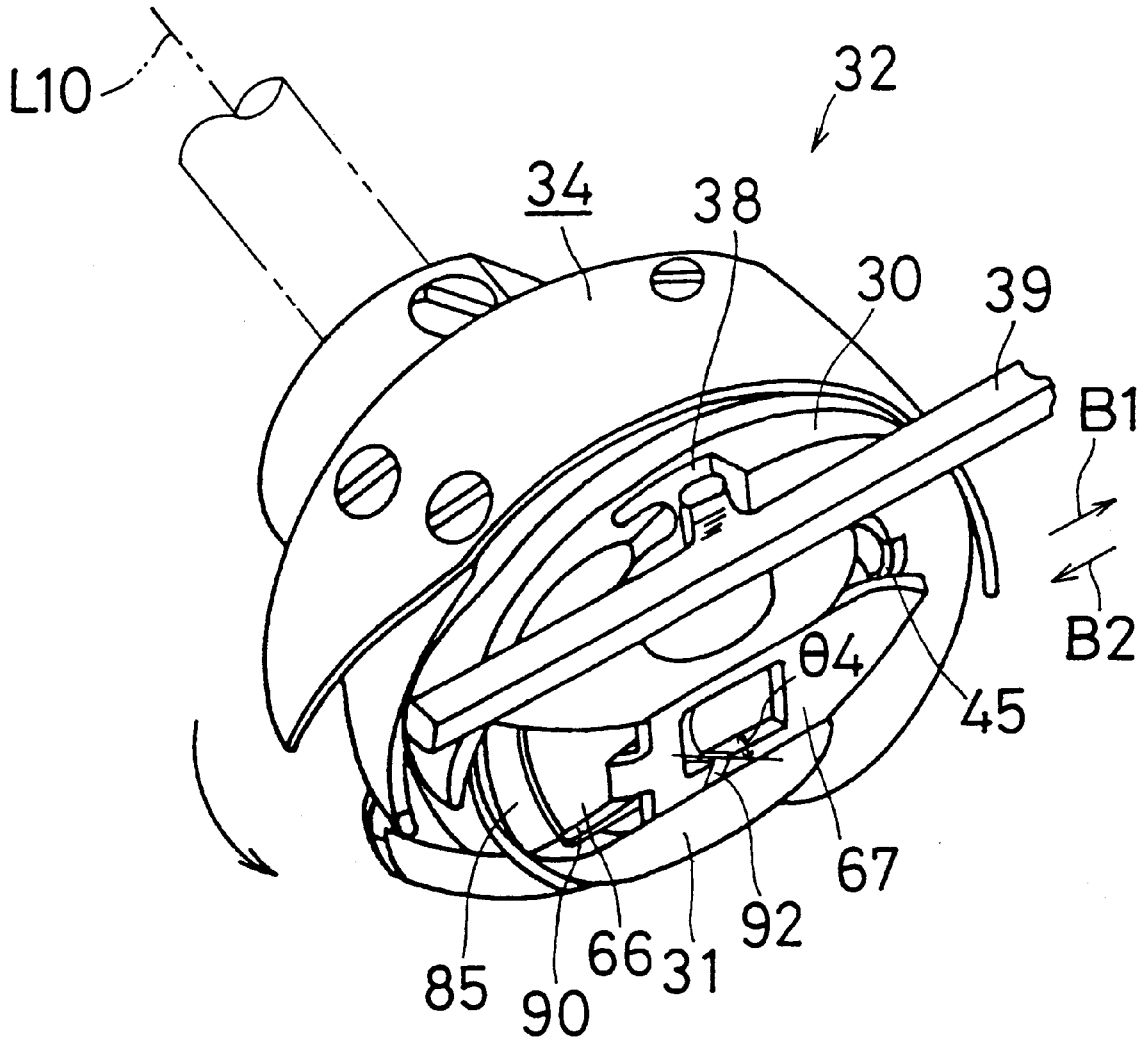
FIG. 4 is a perspective view showing an appearance of the horizontal axis full rotary hook 32 of FIG. 3.

FIG. 3 is a partial cross sectional view of a horizontal axis full rotary hook 32 comprising a bobbin case holder 30 and a bobbin case 31 according to a preferred embodiment of the invention as it is seen from below, and FIG. 4 is a perspective view of the horizontal axis full rotary hook 32. A track groove 35 is formed in a hook body 34 which is driven to rotate about a horizontal rotation axis line L10, to extend in an inner peripheral portion 34*a* in a circumferential direction. With a track projection 36, which is formed in an outer peripheral portion 37 of the bobbin case holder 30, meshed with the track groove 35, the bobbin case holder 30 is housed within the hook body 34 for free rotation. The hook body 34 is of steel or stainless steel. The bobbin case holder 30 is prevented from rotating, by means of a rotation preventing member 39 which is engaged with a rotation preventing recess 38. The bobbin case 31 is detachably attached to the bobbin case holder 30 which has such a structure, and the bobbin case 31 houses a bobbin 40 around which a bobbin thread 62 is wound.

An engagement recess 43 which is recessed in an outward radius direction from an inner peripheral surface 42 is formed in the bobbin case holder 30, and an engagement projection 45 which elastically projects in the outward radius direction from an outer peripheral surface 44 is formed in the bobbin case 31. With the bobbin case 31 mounted in the bobbin case holder 30, the engagement projection 45 elastically abuts with an engagement portion 46 of a flange which is disposed on open end side of the bobbin case holder faces with the engagement recess 43, whereby an engagement surface 47 is formed which projects outward from the inner side of a peripheral wall 60 in the outward radius direction with a distance toward an opening portion of the bobbin case 31 (i.e., the left-hand side in FIG. 3). Further, the engagement projection 45 is provided with an insertion guiding surface 50, which extends in an inward radius direction inward at least from an inner end 49 of the engagement portion 46, in the inward radius direction of the bobbin case with a distance toward the opening portion of the bobbin case 31 from an outermost peripheral portion of the engagement surface 47, i.e., a portion 48 which projects most in the outward radius direction.

Figure 5:
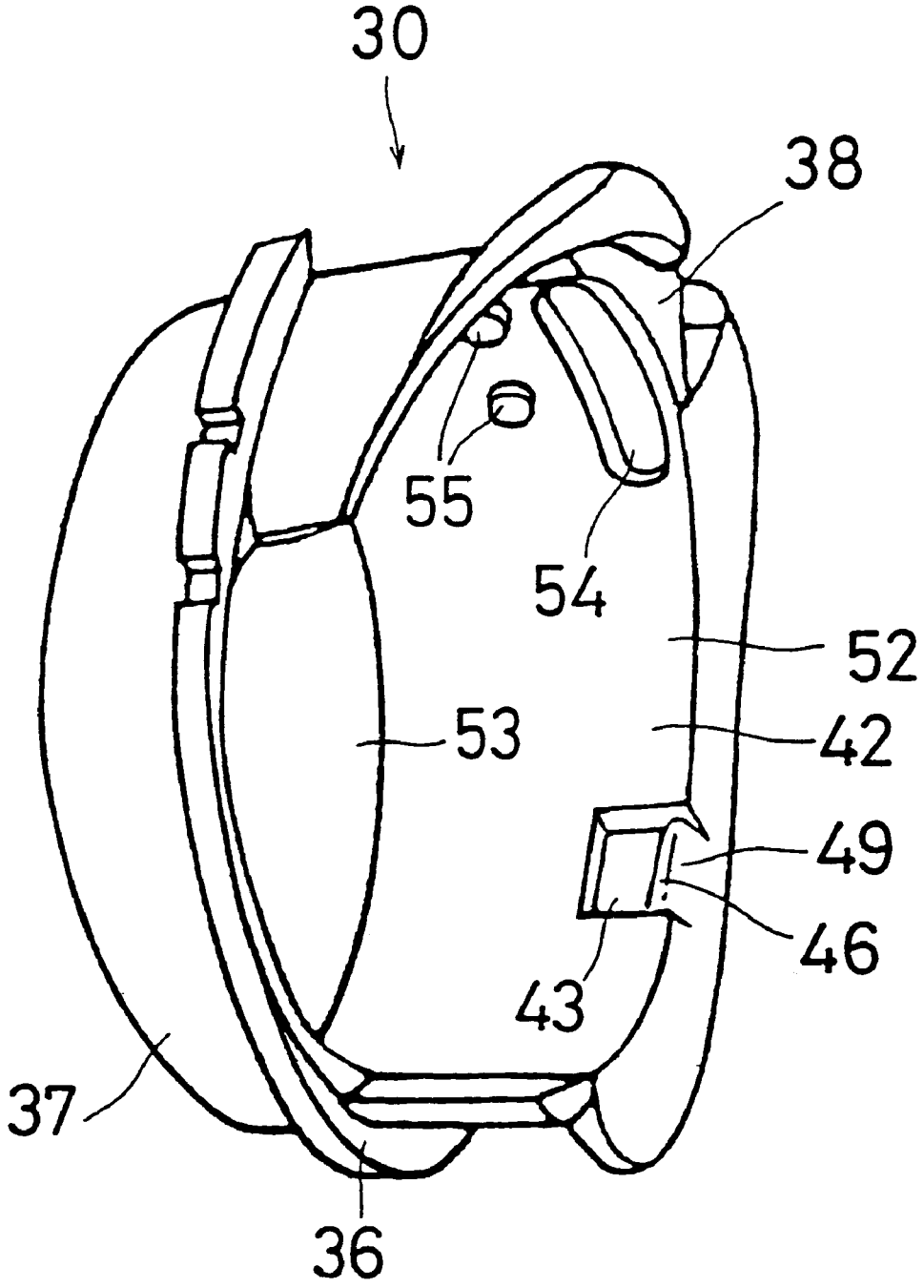
FIG. 5 is a perspective view of a bobbin case holder 30.

FIG. 5 is a perspective view of the bobbin case holder 30. Referring to FIG. 3 as well, the bobbin case holder 30 comprises a peripheral wall 52 and a bottom wall 53 which is a bottom portion which closes one end portion of the peripheral wall 52 in an axial line direction. The bobbin case holder 30 is of steel, stainless steel, or synthetic resin. The projection 36 which projects from the outer peripheral portion 37 in a middle portion in the axial line direction and extends in the circumferential direction is formed in the peripheral wall 52. At one position in the peripheral wall 52 in the circumferential direction, a needle location hole 54 penetrating in the direction of thickness is formed in the vicinity of the open end, so as not to disturb reciprocal movement of a needle not shown. Further, in the peripheral wall 52, at the same position in the circumferential direction as the needle location hole 54, adjacent to the bottom wall 53 in the axial line direction, a positioning projection 55 which projects from the inner peripheral surface 42 is formed, and the rotation preventing recess 38 which is open to the open end side is formed adjacent to the open end side of the needle location hole 54.

The engagement recess 43 is formed in the peripheral wall 52 in the vicinity of the open end, at a position which is displaced by about 90 degrees with respect to the needle location hole 54 in a clockwise direction as viewed from the open end side in the circumferential direction. The engagement recess 43 is obtained by forming a through hole in the peripheral wall 52 which penetrates the peripheral wall 52 in the direction of thickness.

Figure 6:
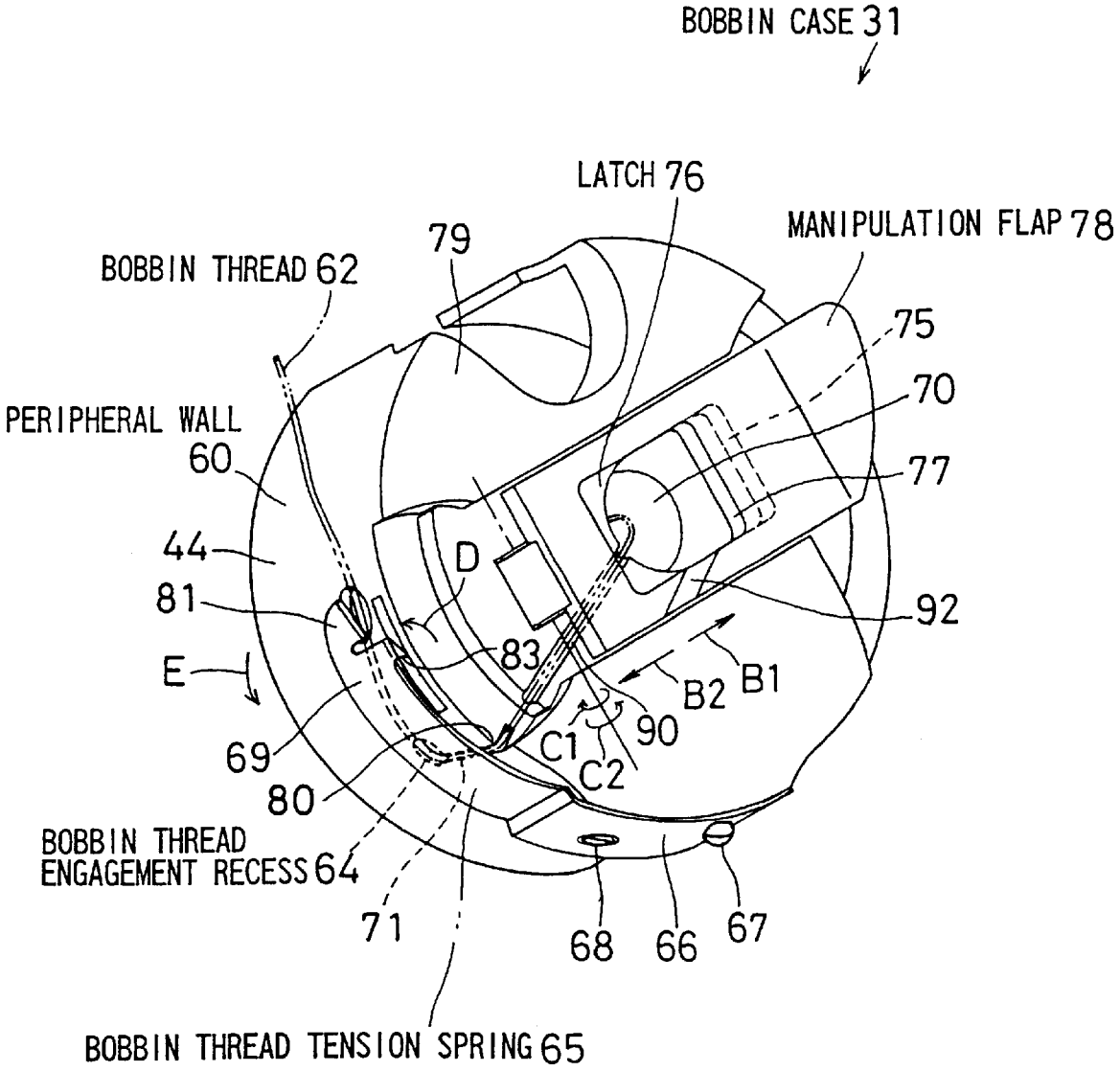
FIG. 6 is a perspective view of a bobbin case 31.

FIG. 6 is a perspective view of the bobbin case 31. The bobbin case 31 which is detachably attached to the bobbin case holder 30 of the horizontal axis full rotary hook 32 comprises the peripheral wall 60 which is divided in the circumferential direction and which is shaped approximately in the form of a letter "C" and an end wall 61 which closes one end portion of the peripheral wall 60 in the axial line direction. The bobbin case 31 is made of steel or stainless steel. A bobbin thread engagement recess 64 which receives the bobbin thread 62 is formed in the peripheral wall 60 so as to penetrate the peripheral wall 60 in the direction of the thickness of the peripheral wall 60, and a bobbin thread tension spring 65 which elastically abuts the outer peripheral surface 44 of the peripheral wall 60 and closes the bobbin thread engagement recess 64 is disposed on the peripheral wall 60. A base end portion 66 of the bobbin thread tension spring 65 is fixed to the peripheral wall 60 by a fixing bolt 67, but by means of an adjustment bolt 68, is capable of adjusting pressing force onto the peripheral wall 60 of an idle end portion 69 side.

A bobbin thread leading hole 70 which the bobbin thread 62 passes through is formed in the end wall 61, more specifically, in a central portion which includes the peripheral wall 60 and a central axial line of the end wall 61. The bobbin thread 62 which is led outside the bobbin case 31 through the bobbin thread leading hole 70 is fit in a bobbin thread guiding groove 71 which is formed in the peripheral wall 60 and led to the bobbin thread engagement recess 64. Since such a bobbin thread guiding groove 71 is disposed, tension or loosening which works on the bobbin thread 62 is prevented from allowing the bobbin thread 62 to escape from between the bobbin thread tension spring 65 and the outer peripheral surface 44 of the peripheral wall 60. Further, a latch 76, in which a first through hole 75 linked to the bobbin thread leading hole 70 is formed, is formed in the end wall 61, in such a manner that one end portion of the latch 76 in a longitudinal direction of the latch 76 can freely shift in directions B1 and B2 respectively toward and away from the bobbin thread guiding groove 71 on one diametral line of the bobbin case 31. A manipulation flap 78, in which a second through hole 77 linked to the first through hole 75 is formed as it is superimposed on the latch, is linked to the latch 76 for free displacement in directions indicated by arrows C1, C2 approximately around the one end portion of the latch 76 in the longitudinal direction of the latch 76, i.e., the center of angular displacement. The peripheral wall 60 and the end wall 61 form a bobbin case body 79 which is generally shaped in the form of a right circular cylinder with a bottom. The bobbin case 31 comprises the bobbin case body 79, the bobbin thread tension spring 65, the latch 76 and the manipulation flap 78.

Figure 7:
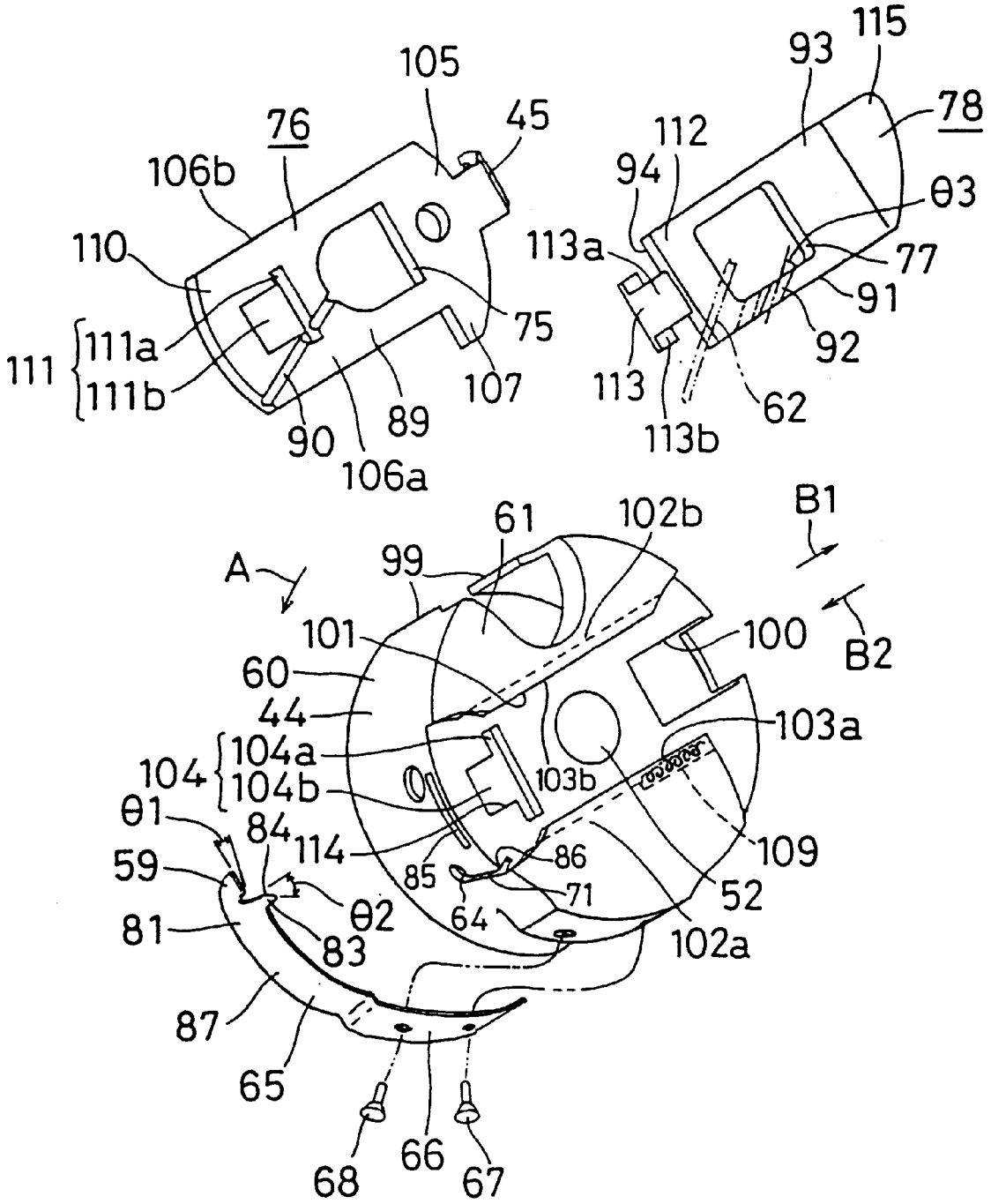
FIG. 7 is an exploded perspective view of the bobbin case 31.

FIG. 7 is an exploded perspective view of the bobbin case 31. With the bobbin thread tension spring 65 fit to the peripheral wall 60, a bobbin thread inserting part 59, which is inclined at an angle θ1 in a direction away from the outer peripheral surface 44 with a distance toward an upstream side A of the direction of rotation of the hook body, is formed at an idle end portion 81 of the bobbin thread tension spring 65, whereas a bobbin thread fall prevention part 83 which is bent approximately perpendicularly in the inward radius direction is formed on the end wall 61 side. On a base end portion 66 side of the bobbin thread fall prevention part 83, with the bobbin thread tension spring 65 attached to the peripheral wall 60, a bobbin thread guiding surface 84 is formed at an angle θ2 toward the idle end portion 81 side from the base end portion 66 inward in the inward radius direction. The angle θ1 is selected as such an angle at which it is possible to insert the bobbin thread 62 which has a diameter of about 0.2 to 0.5 mm at a tip end portion, e.g., as 3 to 10 degrees. The angle θ2 of the bobbin thread guiding surface 84 is selected as 5 to 30 degrees.

A recess groove 85, into which the bobbin thread fall prevention part 83 fits, is formed in the peripheral wall 60, to extend in the circumferential direction. Since the bobbin thread fall prevention part 83 including the bobbin thread guiding surface 84 is formed at the idle end portion 81 of the bobbin thread tension spring 65, when the bobbin thread 62 is guided toward the idle end portion 81 with the bobbin thread 62 caught by a corner portion 86 from the bobbin thread guiding groove 71, spun between the outer peripheral surface 44 and the bobbin thread inserting part 59 and revolved in the direction of an arrow E to be further pulled toward the base end portion 66, the bobbin thread 62 is moved along the bobbin thread guiding surface 84 as indicated by an arrow D in FIG. 6, so that the bobbin thread 62 easily crosses the bobbin thread fall prevention part 83 and guided through toward the bobbin thread inserting part 59 beyond the bobbin thread fall prevention part 83, and hence, that as described above, the bobbin thread 62 passes through between the bobbin thread inserting part 59 and the outer peripheral surface 44 of the peripheral wall 60 and is positioned between an abutment portion 87 which is between the idle end portion 81 and the base end portion 66 and the outer peripheral surface 44 of the peripheral wall 60.

Figure 2:
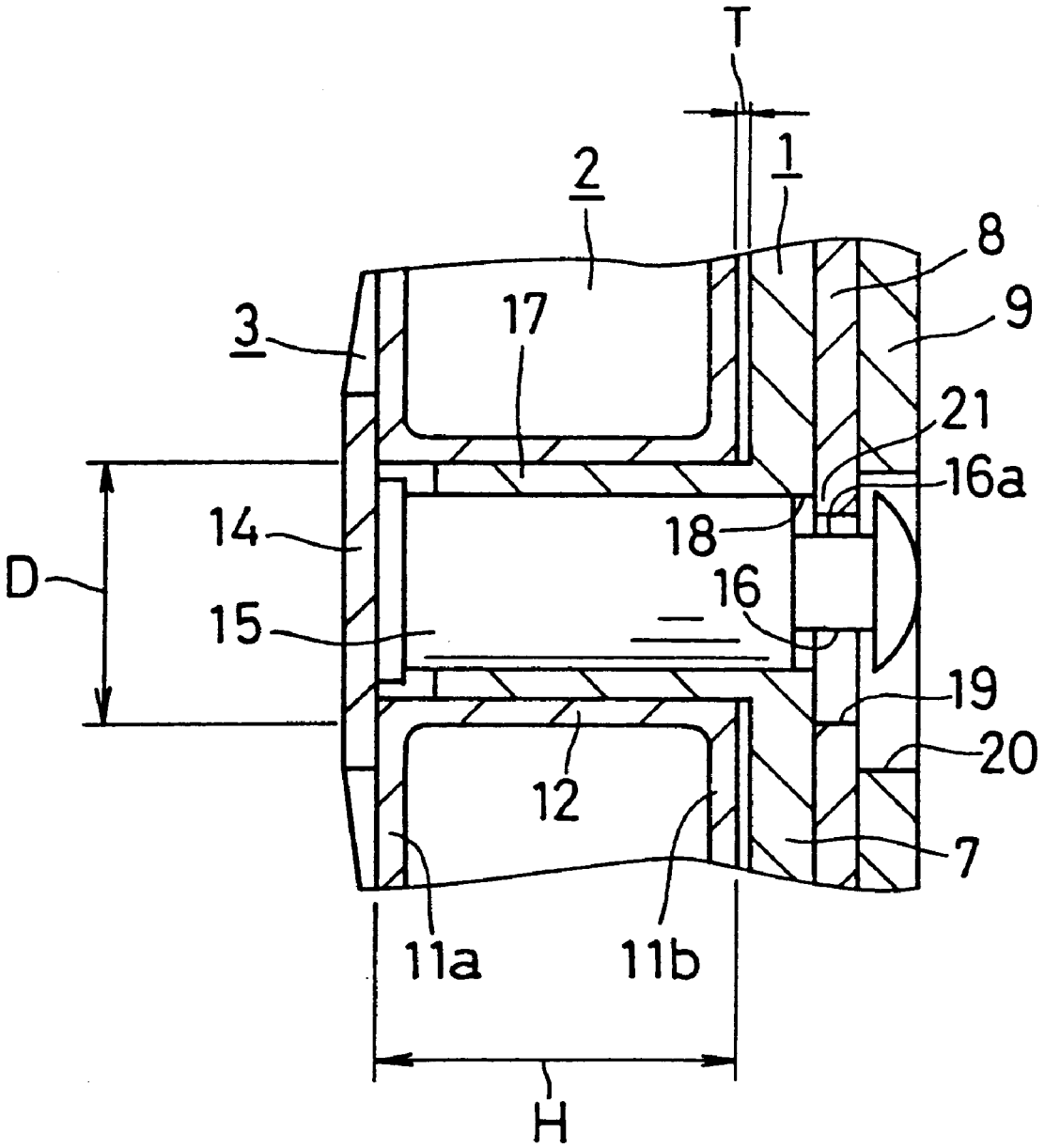
FIG. 2 PRIOR ART
FIG. 2 is an enlarged cross sectional view partially showing a condition in which a bobbin 2 is held in the horizontal axis full rotary hook 22.

The bobbin thread 62 is made externally covered by the bobbin thread tension spring 65, as it is fit in the bobbin thread guiding groove 71 and the bobbin thread engagement recess 64. As pulling the bobbin thread 62 back toward the idle end portion 81 of the bobbin thread tension spring 65, it is possible to place the bobbin thread 62 on the outer peripheral surface 44 of the peripheral wall 60 across the idle end portion 81 of the bobbin thread tension spring 65 from the bobbin thread engagement recess 64 and to elastically press the bobbin thread 62 by means of the bobbin thread tension spring 65. At this stage, since the bobbin thread 62 is fit in the bobbin thread guiding groove 71 and the bobbin thread engagement recess 64, the bobbin thread 62 is not pressed by the abutment portion 87 on the outer peripheral surface 44 of the peripheral wall 60, and therefore, tension force of the bobbin thread 62 does not change in an undesired manner during sewing, so that it is possible to create a seam of a good quality. In such a bobbin case body 79, a cylinder portion 17 (See FIG. 2) like the bobbin case 1 as that shown in FIG. 1 is not formed.

As described earlier, the first through hole 75 is formed in the latch 76 including the engagement projection 45. In an external surface 89 which opposed to the manipulation flap 78 of the latch 76, a second bobbin thread guiding groove 90 is formed which extends straight between the first through hole 75 and the bobbin thread guiding groove 71. The second bobbin thread guiding groove 90 prevents the bobbin thread 62 from getting caught between the latch 76 and the manipulation flap 78 when the latch 76 and the manipulation flap 78 overlap each other approximately in parallel to each other, and hence, since undesired tension force nor loosening is not created, it is possible to smoothly guide the bobbin thread 62 to the bobbin thread guiding groove 71 of the peripheral wall 60.

The second through hole 77 is formed in the manipulation flap 78. A bobbin thread insertion hole 92, which links the second through hole 77 and an external surface 91 of the manipulation flap 78, is formed in the manipulation flap 78. The bobbin thread insertion hole 92 is parallel to the second bobbin thread guiding groove 90, at an angle θ3 to the longitudinal direction in this preferred embodiment. The bobbin thread insertion hole 92 is inclined at an angle θ4 (See FIG. 4) in a direction closer to the second bobbin thread guiding groove 90 of the latch 76 as it is overlapped with a distance toward the inner surface 94 which is faced with the latch 76 from an external surface 93. The angle θ3 is selected as about 30 to 60 degrees, while the angle θ4 is selected as about 45 to 60 degrees, for instance. Thus, by fitting and pushing the bobbin thread 62, which is let outside through the bobbin thread leading hole 70, the first through hole 75 and the second through hole 77 from the bobbin case 31, in the bobbin thread insertion hole 92, it is possible to easily guide the bobbin thread 62 to the second bobbin thread guiding groove 90. Hence, it is not necessary to pass the bobbin thread 62 through between the manipulation flap 78 and the latch 76 with the manipulation flap 78 displaced in angle in the direction C1 away from the latch 76 (See FIG. 6) and fit the bobbin thread 62 in the second bobbin thread guiding groove 90, and therefore, it is possible to easily place the bobbin thread 62 to the second bobbin thread guiding groove 90.

Referring to FIG. 3 again, it is possible to house the bobbin 40 in the bobbin case 31. The bobbin 40 includes a pair of flanges 97*a*, 97*b* and a winding drum 98 which is shaped as a cylinder and which links the flanges 97*a*, 97*b*. The bobbin 40 is of synthetic resin or fiber reinforced synthetic resin. As other material for the bobbin 40, steel, stainless steel or aluminum can be used. It is possible to wind the bobbin thread 62 up to almost an outermost peripheral portion of each one of the flanges 97*a*, 97*b* from the winding drum 98, between the flanges 97*a*, 97*b*.

In the bobbin case body 79 of the bobbin case 31, at a position displacing the bobbin case 31 by about 90 degrees from a dividing portion 99 of the peripheral wall 60 in a clockwise direction as viewed from the end wall 61 side, from the peripheral wall 60 across the end wall 61, a notch 100 which penetrates the peripheral wall 60 and the end wall 61 in the direction of the thickness is formed from the peripheral wall 60 to the end wall 61. Further, a guiding groove 101 which extends in the diametral line direction is formed in the end wall 61, so as to link positions which are shifted about 90 degrees toward the both sides in the circumferential direction from the dividing portion 99 of the peripheral wall 60, i.e., to link the position at which the notch 100 is formed and the side opposite to the same. The both side portions 102*a*, 102*b* of the guiding groove 101 of the direction of width which is perpendicular to the longitudinal direction of the guiding groove 101 are covered with projecting portions 103*a*, 103*b* from the opposite side to the opening portion of the bobbin case 31. Further, to the end wall 61, in the vicinity of one end portion taken in the longitudinal direction at the opposite side to the notch 100 of the guiding groove 101, an engagement hole 104 which penetrates the end wall 61 is formed, so that the engagement hole 104 links the guiding groove 101 and the space within the peripheral wall 60. The engagement hole 104 includes a narrow width portion 104*a* which is toward one end portion taken in the longitudinal direction of the guiding groove 101 and a wide width portion 104*b* which is toward the other end portion taken in the longitudinal direction of the guiding groove 101.

The latch 76 is shaped like a plate, and an engagement projection 45 is integrally formed to the end portion 105 taken in the longitudinal direction. The engagement projection 45 is warped toward one side taken in the thickness direction. An engagement surface 47 of the engagement projection 45 and the outer peripheral surface including the insertion guiding surface 50 are formed in the shape of an arc. The latch 76 is fit into a guiding groove 106, in such a manner that the engagement projection 45 is warped toward the opening portion of the bobbin case 31. In this condition, both side portions 106*a*, 106*b* taken in the width direction which are perpendicular to the longitudinal direction of the latch 76 are locked by the projecting portions 103*a*, 103*b*. The latch 76 is disposed for free movement in a projecting direction B1 in which the engagement projection 45 projects outwardly in the radius direction and an opposite retracting direction B2 in which the engagement projection retracts inwardly in the radius direction along the guiding groove 101, while displacement of the bobbin case 31 in the axial line direction is prevented.

Further, with respect to the latch 76, a spring receiving portion 107 which projects outwardly in the width direction is disposed to the side portion 106*a* which is toward the end portion 105 taken in the longitudinal direction. In addition, in the end wall 61, at a position toward the other end portion taken in the longitudinal direction of the guiding groove 101, along the side portion 102*a* of the width direction, a spring housing recess 108 is formed to house a compressed coil spring 109. Fit in the guiding groove 101 and under spring force of the compressed coil spring 109 in the projecting direction B1, the latch 76 causes the engagement projection 45 to elastically project outwardly in the radius direction from the outer peripheral surface 44 of the peripheral wall 60.

Still further, an engagement flap through hole 111 which penetrates in the thickness direction is formed in the latch 76, at a position near the other end portion 110 of the longitudinal direction. The engagement flap through hole 111 includes a wide width portion 111*a* which is disposed toward the end portion 105 taken in the longitudinal direction of the latch 76 and a narrow width portion 111*b* which is disposed toward the other end portion 110 of the longitudinal direction of the latch 76 The manipulation flap 78 includes an engagement flap 113 at one end portion 112 taken in the longitudinal direction. The engagement flap 113 is warped toward one side in the thickness direction and includes an extending portion 113*a* having a narrow width and an engagement portion 113*b* of a wide width at the tip of the engagement flap 113. The width of the extending portion 113*a* of the engagement flap 113 is selected as a smaller width than the width of the narrow width portion 111*b* of the engagement flap through hole 111 of the latch 76, while the width of the engagement portion 113*b* of the engagement flap 113 is selected as a larger width than the width of the narrow width portion 111*b* of the engagement flap through hole 111 of the latch 76 but as a smaller width than the width of the wide width portion 111*a*. The width of the extending portion 113*a* of the engagement flap 113 is selected as a smaller width than the width of the narrow width portion 104*a* of the engagement hole 104 of the end wall 61. The width of the engagement portion 113*b* of the engagement flap 113 is selected as a larger width than the width of the narrow width portion 104*a* of the engagement hole 104 of the end wall 61 but as a smaller width than the width of the wide width portion 104*b* of the engagement hole 104.

With respect to such an engagement flap 113, the engagement portion 113*b* at the one end portion 112 taken in the longitudinal direction passes through the engagement flap through hole 111 of the latch 76 and is inserted in the engagement hole 104 of the end wall 61. Thus, in a condition that the engagement flap 113 inserted, when there is no external force applied with respect to the engagement flap 113, the engagement portion 113*b* is fit in the wide width portion 104*b* of the engagement hole 104, so that the extending portion 113*a* is inserted in the narrow width portion 111*b* of the engagement flap through hole 111. With respect to the latch 76, the engagement portion 113*b* abuts with the extending portion 113*a* of the engagement flap 113 of the manipulation flap 78 which is locked by a peripheral portion 114 of the engagement hole 104, so that displacement in the projecting direction B1 against the spring force of the compressed coil spring 109 is prevented. At the same time, the engagement portion 113*b* of the engagement flap 113 abuts with the both peripheral portions of the narrow width portion 111*b* of the engagement flap through hole 111 of the latch 76, and therefore, the manipulation flap 78 is prevented from falling through. Thus, prevented from falling through toward the both sides, the manipulation flap 78, as it is superimposed over the latch 76, is linked to the latch 76 for free angular displacement about the center of angular displacement which is the end portion of the engagement portion 113*b* of the engagement flap 113 on the one end portion 112 side of the longitudinal direction, in a raising direction C1 in which the other end portion 115 moves away from the latch 76 and in a dropping direction C2 in which the other end portion 115 moves closer to the latch 76.

When there is no external force acting upon the bobbin case 31, since the latch 76 is under the spring force in the projecting direction B1, while pressing the extending portion 113*a* of the engagement flap 113 of the manipulation flap 78, the latch 76 causes the engagement projection 45 to elastically project from the outer peripheral surface 44 of the peripheral wall 60. At this stage, the manipulation flap 78 is dropped down along the latch 76. As the manipulation flap 78 is operated to displace in angle in the raising direction C1 from this condition, angular displacement of the manipulation flap 78 takes place in the raising direction C1 about the center of angular displacement which is the end portion of the engagement portion 113*b* of the engagement flap 113 on the one end portion 112 side of the longitudinal direction, and therefore, the extending portion 113*a* of the engagement flap 113 is displaced in the same direction as the retracting direction B2 and the latch 76 is accordingly displaced in the retracting direction B2. At this stage, the notch 100 is formed from the peripheral wall 60 to the end wall 61, and hence, the engagement projection 45 is allowed to retract. Further, with respect to the engagement flap 113, angular displacement of the extending portion 113*a* is possible by means of the narrow width portion 104*a* of the engagement hole 104.

Thus, the engagement recess 43 which is recessed in an outward radius direction from the inner peripheral surface 42 is formed in the bobbin case holder 30, and the engagement projection 45 which elastically projects in the outward radius direction from the outer peripheral surface 44 is formed in the bobbin case 31. With the bobbin case 31 mounted in the bobbin case holder 30, the engagement projection 45 is fit in the engagement recess 43. The engagement surface 47 is formed in the engagement projection 45. With the bobbin case 31 mounted in the bobbin case holder 30, the engagement surface 47 elastically abuts the engagement portion 46 of the opening peripheral portion of the engagement recess 43 of the open end side of the bobbin case holder. The elastic force makes it possible to press the bobbin case 31 in the diametral line direction thereof and in the direction toward the bottom wall 53 of the bobbin case holder.

With respect to the bobbin 40 which is firmly held within the bobbin case holder 30 by the bobbin case 31 having such a structure as described above, the outer diameter of the flange 97*a* which is disposed on the bottom wall 53 side of the bobbin case holder 30 is approximately the same as the outer diameter of the peripheral wall 60 of the bobbin case 31 but is a little smaller than the inner diameter of the peripheral wall 52 of the bobbin case holder 30. Further, the outer diameter of the other flange 97*b* which is disposed on the open end side of the bobbin case holder 30 is smaller than the inner diameter of the peripheral wall 60 of the bobbin case 31. An outermost peripheral portion 121 of the other flange 97*b* includes a first gap 122 having a distance T1 through which the bobbin thread 62 can idly pass through, against the inner peripheral surface of the peripheral wall 60. In addition, the other flange 97*b* is formed at an angle $\alpha$ in a direction closer to the another flange 97*a* with a distance outwardly in the radius direction. The angle $\alpha$ is selected as 3 to 15 degrees, for example. The length of the bobbin 40 at the center in the axial line direction is shorter than a distance between an inner surface 53*a* of the bottom wall 53 of the bobbin case holder 30 which is faced with the open end and an inner surface 61*a* which is faced with the bottom wall 53 of the end wall 61 of the bobbin case 31, whereby a second gap 123 is created between the end wall 61 of the bobbin case 31 and the other flange 97*b* of the bobbin 40.

Intersecting portions 124*a*, 124*b* of the flanges 97*a*, 97*b* and the winding drum 98 are formed in an arc shape in cross section taken along one plane which includes the axial line of the bobbin 40. Further, as described earlier, the flange 97*b* of the open end side is inclined in the direction closer to the flange 97*a* of the bottom wall 53 side with a distance outwardly in the radius direction, and therefore, a bobbin winding space 125 in which the bobbin thread 62 is wound up is U-shaped in cross section, so that the amount of winding the bobbin thread 62 in a region close to the winding drum 98 is reduced. The reason is to prevent that when the diameter of the bobbin thread 62 which is wound around the winding drum 98 between the flanges 97*a*, 97*b* decreases, the speed at which the bobbin thread 62 is unwound while rotating on the outermost peripheral portion 121 of the flange 97*b* of the open end side becomes extremely large as the bobbin thread 62 is pulled out and undesirably large tangling is applied to the bobbin thread 62. The outermost peripheral portion 121 of the flange 97*b* of the open end side may be formed in a shape which is smoothly warped as a convex outwardly in the radius direction in cross section as shown in FIG. 3, so as to make it possible to smoothly move the bobbin thread 62 in the direction in which the bobbin thread 62 is pulled out.

The bobbin thread leading hole 70 is formed in the end wall 61 of the bobbin case 31, the first through hole 75 is formed in the latch 76, and the second through hole 77 is formed in the manipulation flap 78, as described earlier. A gap for passing the bobbin thread 62 through is formed, including the first gap 122, the second gap 123, the bobbin thread leading hole 70, the first through hole 75 and the second through hole 77. A peripheral portion 126 which is opposed to the inner surface 61*a* of the bobbin thread leading hole 70 of the end wall 61 is warped round, and rotates as the bobbin thread 62 is pulled out when the bobbin thread 62 is spun between the peripheral portion 126 and the outermost peripheral portion 121 of the flange 97*b* of the open end side. As this occurs, since the peripheral portion 126 is warped round, there is no possibility that the bobbin thread 62 will be damaged by a corner portion. Hence, large friction force does not work in the axial line direction of the bobbin thread 62, i.e., the direction in which the bobbin thread 62 is pulled out, and a slide resistance at the inner peripheral surface of the bobbin thread leading hole 70 is small, which in turn prevents the tension force of the bobbin thread 62 from changing undesirably.

The outermost peripheral portion of the flange 97*a*, which is disposed on the bottom wall 53 of the bobbin 40, and a portion around the same is elastically pressed by an open end portion 127 of the peripheral wall 60 of the bobbin case which is mounted in the bobbin case holder 30 in the direction closer to the bottom wall 53 and is held within the bobbin case holder in this condition, and therefore, even though the bobbin thread 62 is pulled out, the bobbin 40 rotates the bobbin thread 62 about the axial line of the bobbin 40 so that the bobbin thread 62 is pulled out while rotating on the outermost peripheral portion of the flange 97*b* of the open end side. Hence, unlike in the conventional technique, there is no possibility that the bobbin thread 62 will be excessively loosened to be tangled within the bobbin case 31 due to inertia which is created as the bobbin 40 rotates, and therefore, it is possible to smoothly supply the bobbin thread 62 and to prevent the tension force of the bobbin thread 62 from changing during sewing. This eliminates a variation in the tension force of the bobbin thread 62, and consequently, nonuniform fastening of the thread is prevented and the quality of sewing is improved.

Figure 8:
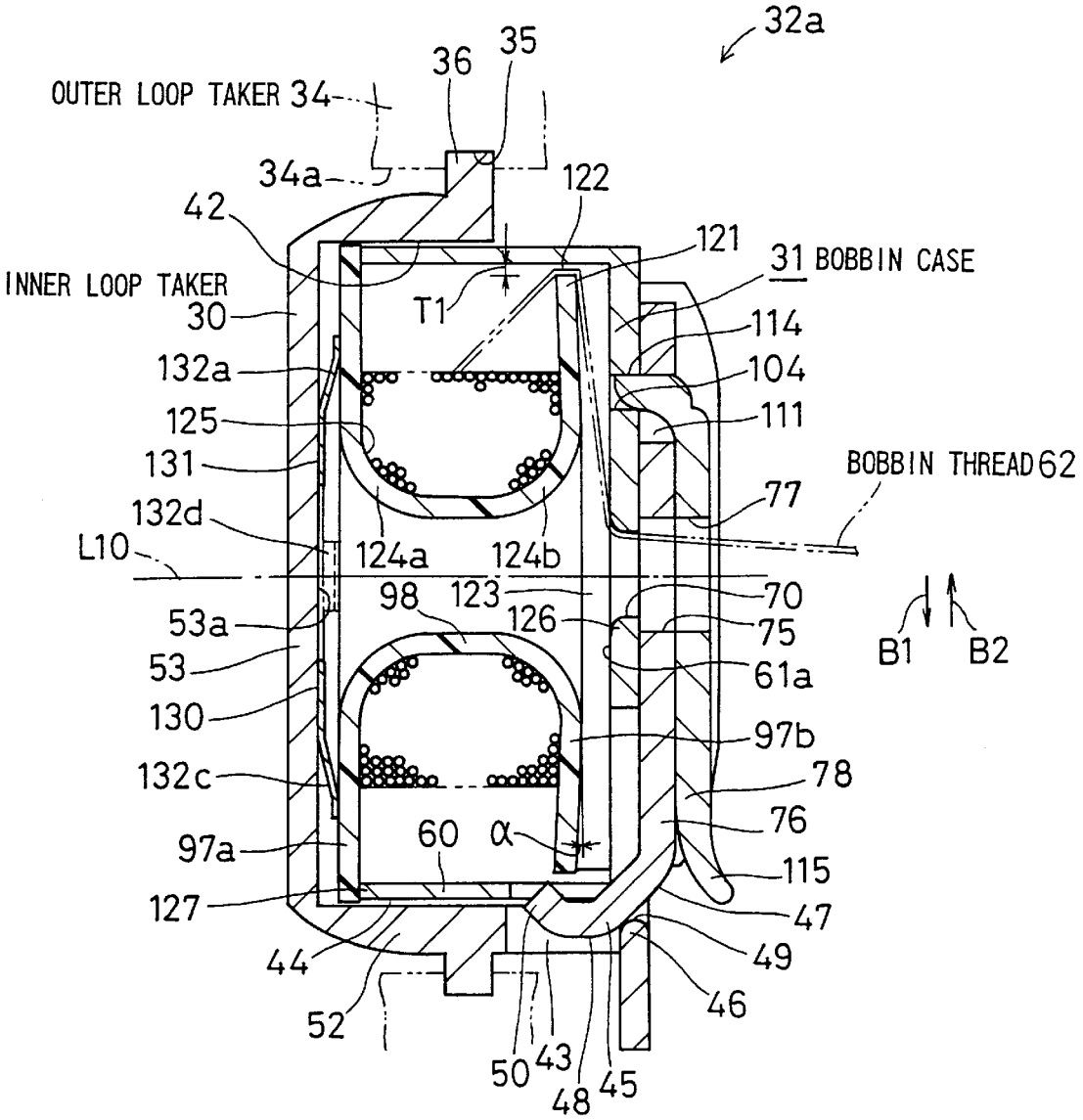
FIG. 8 is a horizontal cross sectional view of a portion of a horizontal axis full rotary hook 32*a* according to other preferred embodiment of the invention as it is seen from below.
Figure 9:
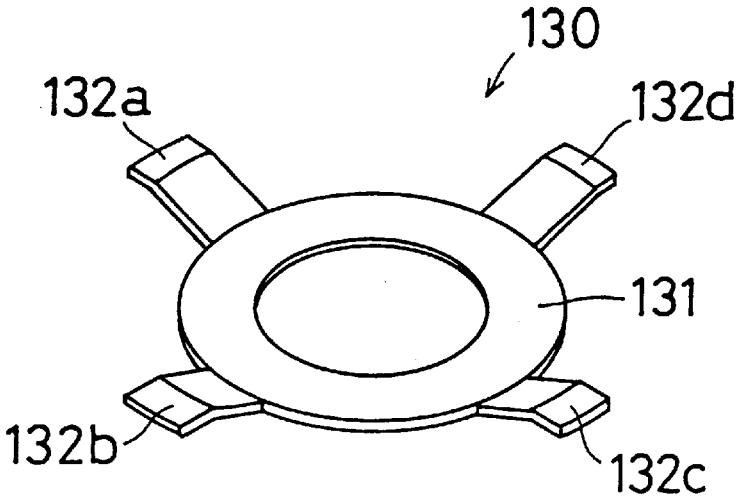
FIG. 9 is a perspective view of a blade spring 130.

FIG. 8 is a cross sectional view of a portion of a horizontal axis full rotary hook 32*a* according to other preferred embodiment of the invention. Identical reference symbols will be assigned to corresponding portions to FIGS. 3 to 7. In this preferred embodiment, a blade spring 130 as that shown in FIG. 9 is fixed by welding, for example, to the inner surface 53*a* of the bottom wall 53 of the bobbin case holder 30 which is faced with the open end. The blade spring 130 includes a base portion 131 of a ring-shaped thin plate which is fixed in parallel to the inner surface 53*a* of the bottom wall 53, and a plurality of pressing flaps 132*a* to 132*d* (four pressing flaps in this preferred embodiment) which extend at equal intervals in the circumferential direction from an outer peripheral portion of the base portion 131 outwardly in the radius direction and which extend beyond one surface of the base portion 131 toward one side of the axial direction. Such a blade spring 130 elastically presses the flange 97*a* of the bottom wall 53 side of the bobbin 40, toward the open end side. In this condition, since the bobbin case 31 is pressed by the spring force of the compressed coil spring 109 of the latch 76 in the direction closer to the bottom wall 53, i.e., toward the left-hand side in FIG. 8, the outer peripheral portion of the flange 97*b* is elastically pressed by the pressing flaps 132*a* to 132*d* of the blade spring 130, as it is supported on the open end portion 127 of the peripheral wall 60 of the bobbin case 31. Hence, the bobbin 40 can displace in direction closer to the bottom wall 53, as it is elastically pressed by the blade spring 130. Therefore, the spring force of the compressed coil spring 109 does not have to be unnecessarily large spring force for the purpose of pressing the bobbin 40 by means of the bobbin case 31, but rather may be large enough to prevent the bobbin case 31 from falling from the bobbin case holder 30. Hence, a known compressed coil spring 109 may be used. Further, since the engagement projection 45 of the latch 76 abuts the engagement portion 46 without fail, it is not necessary to adjust the quantity of the engagement portion 46 projecting inwardly or outwardly in the radius direction and depending on the thickness of the flange 97*a,* which saves troubles during production.

Figure 10:
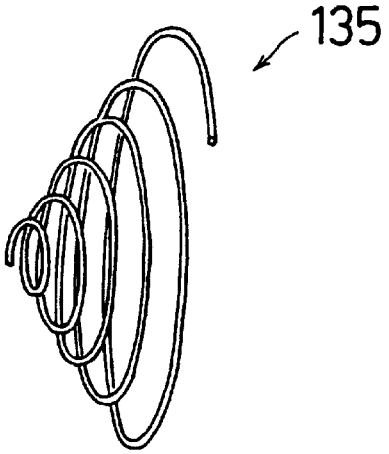
FIG. 10 is a perspective view of a conical coil spring 135.

As other preferred embodiment of the invention, instead of the blade spring 130 which is shown in FIG. 9, a conical coil spring 135 as that shown in FIG. 10 may be used, or alternatively, a spring having other structure may be appropriately selected and used.

Figure 11:
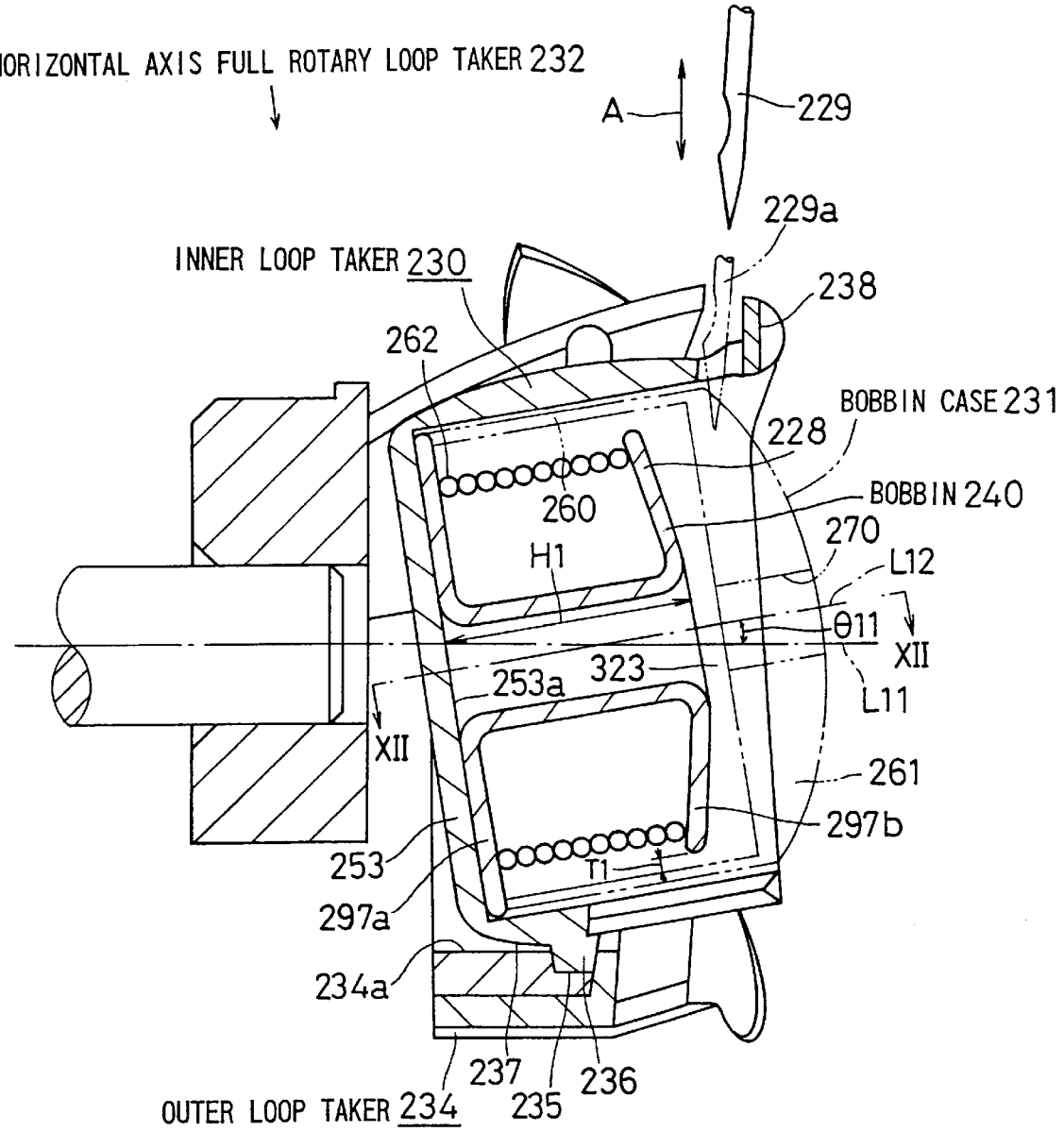
FIG. 11 is a vertical cross sectional view of a horizontal axis full rotary hook 232 according to still other preferred embodiment of the invention.

FIG. 11 is a vertical cross sectional view of a horizontal axis full rotary hook 232 comprising a bobbin case holder 230 and a bobbin case 231 according to still other preferred embodiment of the invention. A track groove 235 is formed in a hook body 234 which is driven to rotate about a horizontal rotation axis line L11, to extend in an inner peripheral portion 234*a* in the circumferential direction. With a track projection 236, which is formed in an outer peripheral portion 237 of the bobbin case holder 230, meshed with the track groove 235, the bobbin case holder 230 is housed within the hook body 234 for free rotation. The bobbin case holder 230 is prevented from rotating, by means of a rotation preventing member not shown which is engaged with a rotation preventing recess 238. The bobbin case 231 is detachably attached to the bobbin case holder 230 which has such a structure, and the bobbin case 231 houses a bobbin 240 around which a bobbin thread 262 is wound.

The bobbin 240 is housed in the bobbin case 231. The bobbin 240 includes a pair of flanges 297*a,* 297*b* and a winding drum 298 which is shaped as a cylinder and which links the flanges 297*a,* 297*b*. The bobbin thread 262 is wound up to a vicinity of an outermost peripheral portion of each one of the flanges 297*a,* 297*b* from the winding drum 298, between the flanges 297*a,* 297*b*.

In the bobbin case holder 230, an idle end portion 228 of the bobbin 240 which is closest to a needle 229, i.e., the top end portion of the flange 297*b* in FIG. 11 is disposed inclined in a direction away from the lowest point 229*a* of a needle 229, in a path in which the needle 229 which extends up and down moves in FIG. 11, at an angle θ11 with respect to the axial line L12 of the bobbin case holder 230 and the rotation axis line L11 of the hook body 234. The angle θ11 is determined so that the needle 229 does not hit the flange 297*b* at the lowest point 229*a* of the needle 229. For instance, the angle θ11 is 5 degrees or larger.

Thus, by inclining the axial line L12 of the bobbin case holder 230 at the angle θ11 with respect to the rotation axis line L11 of the hook body 234, the length H1 of the winding drum 298 of the bobbin 240 is extended toward the open end side of the bobbin case holder 230. This makes it possible to increase the amount of winding the bobbin thread 262.

Figure 12:
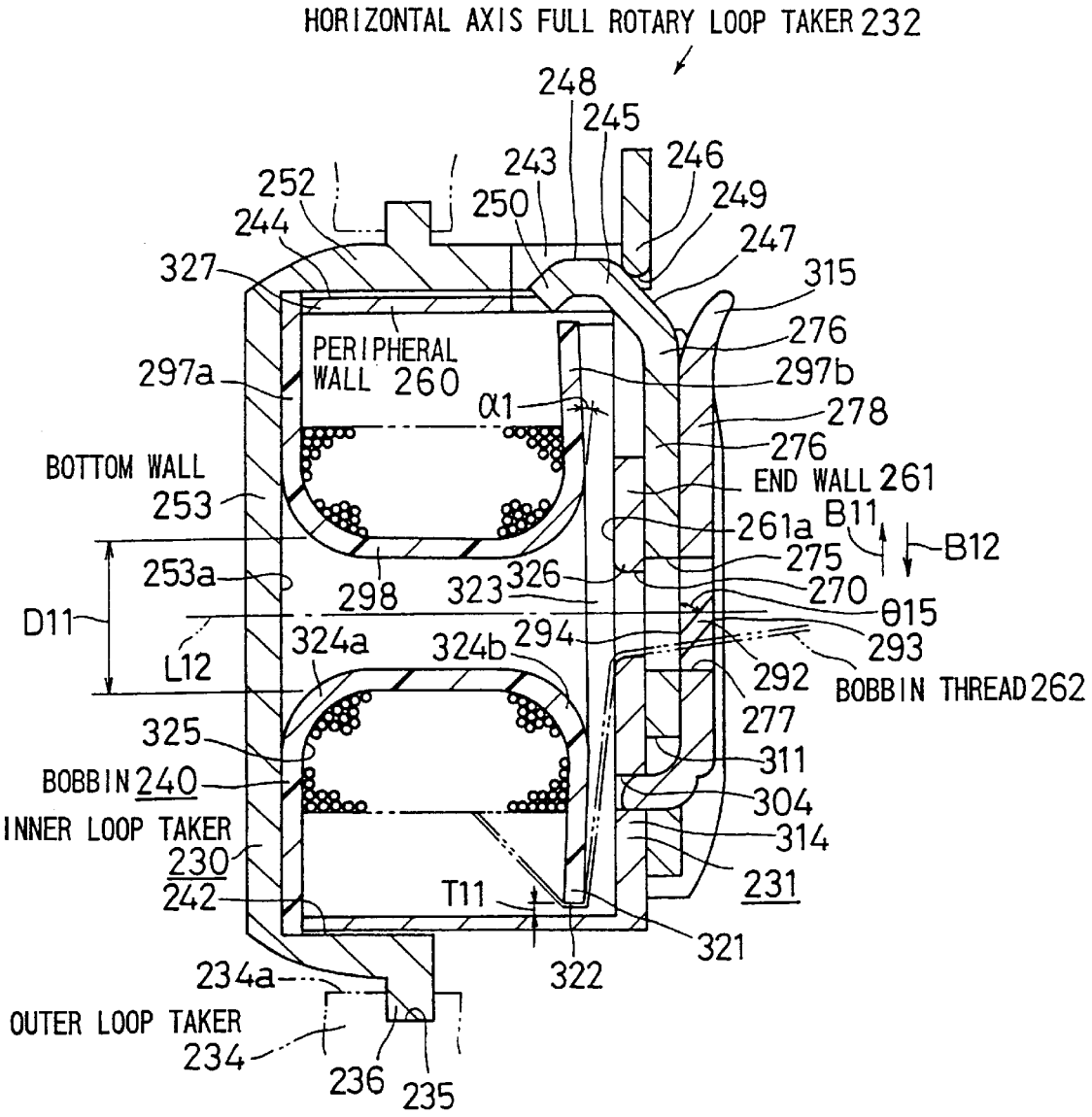
FIG. 12 is a partial cross sectional view of FIG. 11 taken along XII—XII.

FIG. 12 is a partial cross sectional view of FIG. 11 taken along XII—XII. An engagement recess 243 which is recessed in an outward radius direction from an inner peripheral surface 242 is formed in the bobbin case holder 230, and an engagement projection 245 which elastically projects in the outward radius direction from an outer peripheral surface 244 is formed in the bobbin case 231. With the bobbin case 231 mounted in the bobbin case holder 230, the engagement projection 245 elastically abuts with an engagement portion 246 of a flange 297*b* which is disposed on open end side of the bobbin case holder faces with the engagement recess 243, whereby an engagement surface 247 is formed which projects outward from the inner side of a peripheral wall 260 in the outward radius direction with a distance toward an opening portion of the bobbin case 231 (i.e., the left-hand side in FIG. 11). Further, the engagement projection 245 is provided with an insertion guiding surface 250, which extends in an inward radius direction inward at least from an inner end 249 of the engagement portion 246, in the inward radius direction of the bobbin case with a distance toward the opening portion of the bobbin case 231 from an outermost peripheral portion of the engagement surface 247, i.e., a portion 248 which projects most in the outward radius direction.

Figure 13:
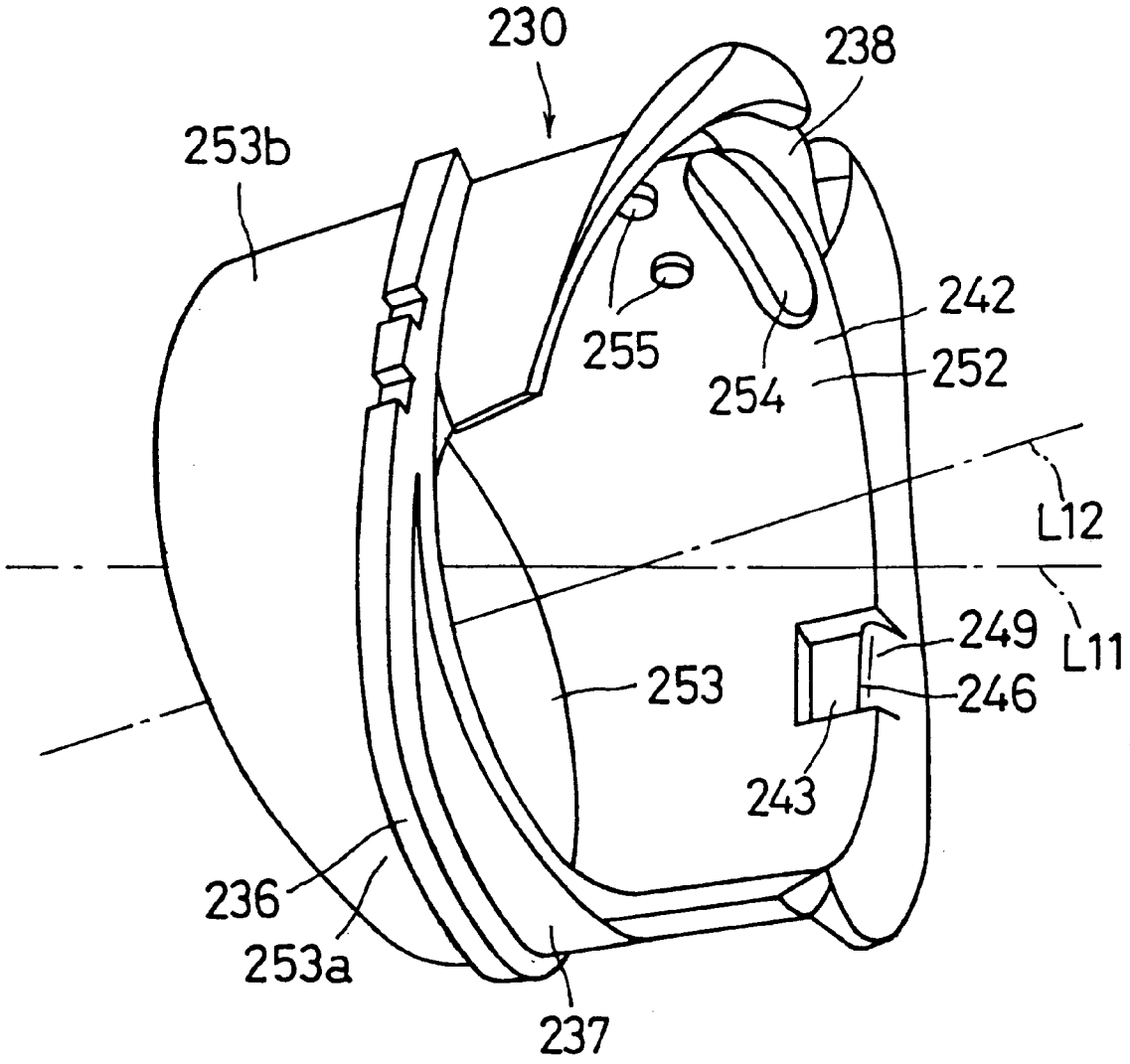
FIG. 13 is a perspective view of a bobbin case holder 230.

FIG. 13 is a perspective view of the bobbin case holder 230. Referring to FIG. 12 as well, the structure of the bobbin case holder 230 is explained. The bobbin case holder 230 comprises a peripheral wall 252 and a bottom wall 253 which is a bottom portion which closes one end portion of the bobbin case holder 230 in an axial line direction. The projection 236 which projects from the outer peripheral portion 237 and extends in the circumferential direction with using a rotation axial line L11 as the center is formed in the peripheral wall 252. At one position in the peripheral wall 252 in the circumferential direction, a needle location hole 254 penetrating in the direction of thickness is formed in the vicinity of the open end, so as not to disturb movement of a needle. Further, in the peripheral wall 252, at the same position in the circumferential direction as the needle location hole 254, adjacent to the bottom wall 253 in the axial line direction, a positioning projection 255 of the bobbin case 231 which projects from the inner peripheral surface 242 is formed, and a rotation preventing recess 238 which is open to the open end side is formed adjacent to the open end side of the needle location hole 254.

The engagement recess 243 is formed in the peripheral wall 252 in the vicinity of the open end, at a position which is displaced by about 90 degrees with respect to the needle location hole 254 in a clockwise direction as viewed from the open end side in the circumferential direction. The engagement recess 243 is obtained by forming a through hole in the peripheral wall 252 which penetrates the peripheral wall 252 in the direction of thickness.

A portion of bottom wall 253 of the bobbin case holder 230 is inclined in a direction away from the open end from a bottom end portion 253*a* toward a top end portion 253*b* toward as shown in FIG. 13 and the top end portion 253*b* has a shape as that shown in FIG. 13 which swallows up to the left-hand side. Hence, a thread smoothly slides from the bottom end portion 253*a* to the top end portion 253*b* of bottom wall 253, thereby ensuring crossing of the thread.

Figure 14:
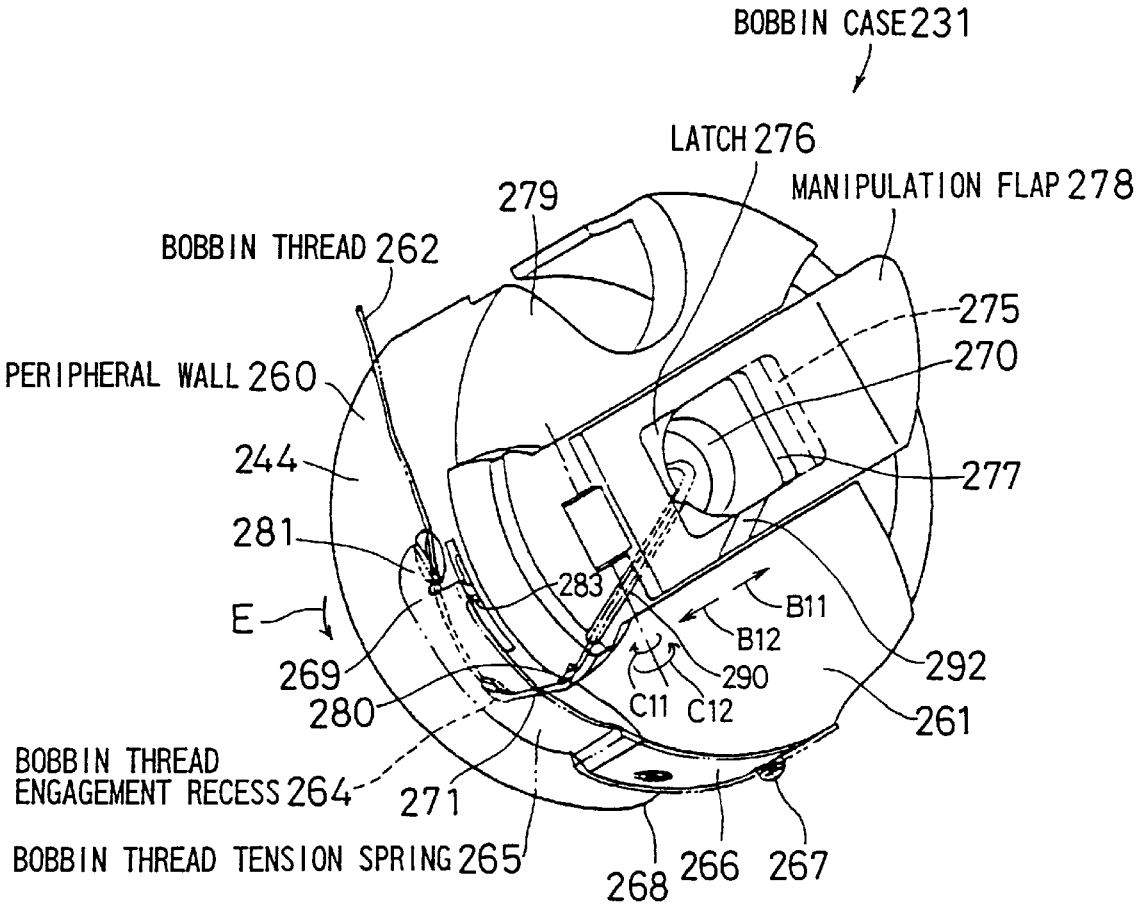
FIG. 14 is a perspective view of a bobbin case 231.

FIG. 14 is a perspective view of the bobbin case 231. The bobbin case 231 which is detachably attached to the bobbin case holder 230 of the horizontal axis full rotary hook 232 comprises the peripheral wall 260 which is divided in the circumferential direction and which is shaped approximately in the form of a letter "C" and an end wall 261 which closes one end portion of the peripheral wall 260 in the axial line direction. A bobbin thread engagement recess 264 which receives the bobbin thread 262 is formed in the peripheral wall 260 so as to penetrate the peripheral wall 260 in the direction of the thickness, and a bobbin thread tension spring 265 which elastically abuts the outer peripheral surface 244 of the peripheral wall 260 and closes the bobbin thread engagement recess 264 is disposed to the peripheral wall 260. A base end portion 266 of the bobbin thread tension spring 265 is fixed to the peripheral wall 260 by a fixing bolt 267, but by means of an adjustment bolt 268, is capable of adjusting pressing force onto the peripheral wall 260 of an idle end portion 269 side.

A bobbin thread leading hole 270 which the bobbin thread 262 passes through is formed in a central portion which includes a central axial line of the end wall 261. The bobbin thread 262 which is led outside the bobbin case 231 through the bobbin thread leading hole 270 is fit in a bobbin thread guiding groove 271 which is formed in the peripheral wall 260 and led to the bobbin thread engagement recess 264. Since such a bobbin thread guiding groove 271 is disposed, tension or loosening which works on the bobbin thread 262 is prevented from allowing the bobbin thread 262 to escape from between the bobbin thread tension spring 265 and the outer peripheral surface 244 of the peripheral wall 260. Further, a latch 276, in which a first through hole 275 linked to the bobbin thread leading hole 270 is formed, is formed in the end wall 261, in such a manner that the latch 276 can freely shift in directions B11 and B12 respectively toward and away from the bobbin thread guiding groove 271 on one diametral line of the bobbin case 231. A manipulation flap 278, in which a second through hole 277 linked to the first through hole 275 is formed as it is superimposed on the latch 276, is linked to the latch 276 for free displacement in directions indicated by arrows C11, C12. The peripheral wall 260 and the end wall 261 form a bobbin case body 279 which is generally shaped in the form of a right circular cylinder with a bottom. The bobbin case 231 comprises the bobbin case body 279, the bobbin thread tension spring 265, the latch 276 and the manipulation flap 278.

Figure 15:
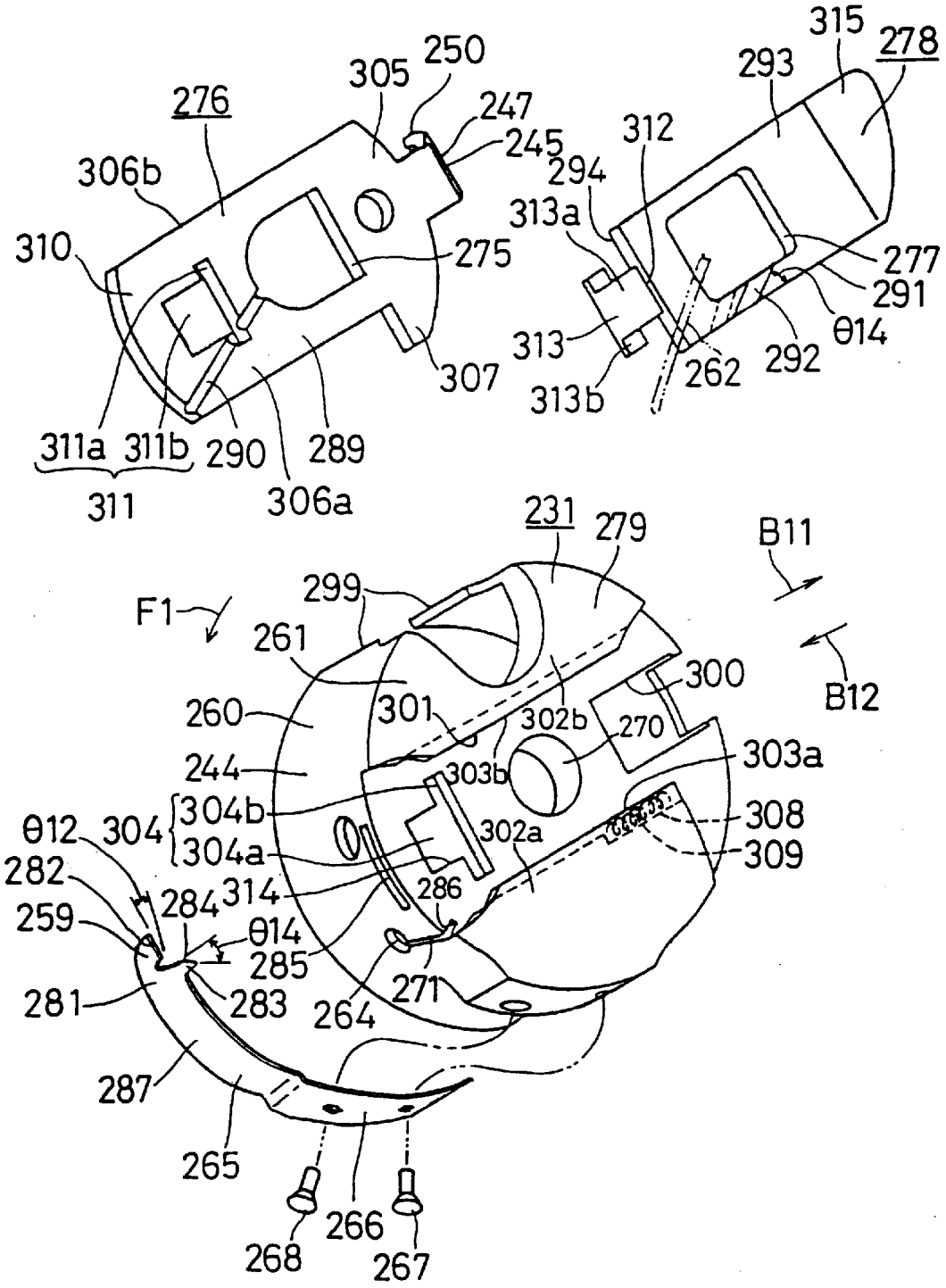
FIG. 15 is an exploded perspective view of the bobbin case 231.

FIG. 15 is an exploded perspective view of the bobbin case 231. With the bobbin thread tension spring 265 fit to the peripheral wall 260, a bobbin thread inserting part 282, which is inclined at an angle θ12 in a direction away from the outer peripheral surface 244 with a distance toward an upstream side F1 of the direction of rotation of the hook body, is formed at an idle end portion 281 of the bobbin thread tension spring 265, whereas a bobbin thread fall prevention part 283 which is bent approximately perpendicularly in the inward radius direction is formed on the end wall 261 side. In the bobbin thread fall prevention part 283, with the bobbin thread tension spring 265 attached to the peripheral wall 260, a bobbin thread guiding surface 284 is formed at an angle θ13 toward the idle end portion 281 side from the base end portion 266 inward in the inward radius direction. The angle θ12 is selected as such an angle at which it is possible to insert the bobbin thread 262 which has a diameter of about 0.2 to 0.5 mm at a tip end portion, e.g., as 3 to 10 degrees. The angle θ13 of the bobbin thread guiding surface 284 is selected as 5 to 30 degrees. A recess groove 285, into which the bobbin thread fall prevention part 283 fits, is formed in the peripheral wall 260 to extend in the circumferential direction.

To locate the bobbin thread as shown in FIG. 14, first, the bobbin thread 262 is guided to the idle end portion 281 from outside to place the bobbin thread 262 between the outer peripheral surface 244 and the bobbin thread inserting part 282 from above, revolved in the direction of an arrow E1 and pulled toward the base end portion 266. At this stage, since the bobbin thread fall prevention part 283 including the bobbin thread guiding surface 284 is formed at the idle end portion 281 of the bobbin thread tension spring 265, the bobbin thread 262 is moved along the bobbin thread guiding surface 284 so that the bobbin thread 262 easily crosses the bobbin thread fall prevention part 283. Following this, by further pulling the bobbin thread 262 toward the base end portion 266 and revolving the bobbin thread 262 toward the idle end portion 281 with the bobbin thread 262 caught by a corner portion 286 from the bobbin thread guiding groove 271, the bobbin thread 262 is pulled out through the idle end portion 281 as shown in FIG. 14, passing through between an abutment portion 287 between the idle end portion 281 and the base end portion 266, and the outer peripheral surface 244 of the peripheral wall 260.

Thus, the bobbin thread 262 is made externally covered by the bobbin thread tension spring 265, as it is fit in the bobbin thread guiding groove 271 and the bobbin thread engagement recess 264, placed on the outer peripheral surface 244 of the peripheral wall 260 across the idle end portion 281 of the bobbin thread tension spring 265 from the bobbin thread engagement recess 264 and elastically pressed by means of the bobbin thread tension spring 265. At this stage, since the bobbin thread 262 is fit in the bobbin thread guiding groove 271 and the bobbin thread engagement recess 264, the bobbin thread 262 is not pressed by the abutment portion 287 on the outer peripheral surface 244 of the peripheral wall 260, and therefore, tension force of the bobbin thread 262 does not change in an undesired manner during sewing, so that it is possible to create a seam of a good quality. In such a bobbin case body 279, the cylinder portion 27 of the conventional bobbin case 1 (See FIG. 2) is not formed, and the stud 15 which is inserted in the cylinder portion 27 is not formed in the bobbin case holder 230, and therefore, it is possible to reduce the diameter D of the winding drum 298 of the bobbin 240 and further increase the amount of winding the bobbin thread 262.

As described earlier, the first through hole 275 is formed in the latch 276 including the engagement projection 245. In an external surface 289 which opposed to the manipulation flap 278 of the latch 276, a second bobbin thread guiding groove 290 is formed which extends straight between the first through hole 275 and the bobbin thread guiding groove 271. The second bobbin thread guiding groove 290 prevents the bobbin thread 262 from getting caught between the latch 276 and the manipulation flap 278 when the latch 276 and the manipulation flap 278 overlap each other approximately in parallel to each other, and hence, since undesired tension force nor loosening is not created, it is possible to smoothly guide the bobbin thread 262 to the bobbin thread guiding groove 271 of the peripheral wall 260.

The second through hole 277 is formed in the manipulation flap 278. A bobbin thread insertion hole 292, which is notched to link the second through hole 277 and an external surface 291 of the manipulation flap 278, is formed in the manipulation flap 278. The bobbin thread insertion hole 292 is parallel to the second bobbin thread guiding groove 290, at an angle θ14 to the longitudinal direction in this preferred embodiment. The bobbin thread insertion hole 292 is inclined at an angle θ15 (See FIG. 12) in a direction closer to the second bobbin thread guiding groove 290 of the latch 276 as it is overlapped with a distance toward the inner surface 294 which is faced with the latch 276 from the external surface 293. The angle θ14 is selected as about 30 to 60 degrees, while the angle θ15 is selected as about 45 to 60 degrees, for instance. Thus, by fitting and pushing the bobbin thread 262, which is let outside through the bobbin thread leading hole 270, the first through hole 275 and the second through hole 277 from the bobbin case 231, in the bobbin thread insertion hole 292, it is possible to easily guide the bobbin thread 262 to the second bobbin thread guiding groove 290. Hence, it is not necessary to raise the manipulation flap 278, pass the bobbin thread 262 through between the manipulation flap 278 and the latch 276 and fit the bobbin thread 262 in the second bobbin thread guiding groove 290, and therefore, it is possible to easily place the bobbin thread 262 to the second bobbin thread guiding groove 290.

In the bobbin case body 279 of the bobbin case 231, at a position displacing the bobbin case 231 by about 90 degrees from a dividing portion 299 of the peripheral wall 260 in a clockwise direction as viewed from the end wall 261 side, from the peripheral wall 260 across the end wall 261, a notch 300 which penetrates the peripheral wall 260 and the end wall 261 in the direction of the thickness is formed from the peripheral wall 260 to the end wall 261. Further, a guiding groove 301 which extends in the diametral line direction is formed in the end wall 261, so as to link positions which are shifted about 90 degrees toward the both sides in the circumferential direction from the dividing portion 299 of the peripheral wall 260, i.e., to link the position at which the notch 300 is formed and the side opposite to the same. The both side portions 302*a*, 302*b* of the guiding groove 301 of the direction of width which is perpendicular to the longitudinal direction of the guiding groove 301 are covered with projecting portions 303*a*, 303*b* from the opposite side to the opening portion of the bobbin case 231. Further, to the end wall 261, in the vicinity of one end portion taken in the longitudinal direction at the opposite side to the notch 300 of the guiding groove 301, an engagement hole 304 which penetrates the end wall 261 is formed, so that the engagement hole 304 links the guiding groove 301 and the space within the peripheral wall 260. The engagement hole 304 includes a narrow width portion 304*a* which is toward one end portion taken in the longitudinal direction of the guiding groove 301 and a wide width portion 304*b* which is toward the other end portion taken in the longitudinal direction of the guiding groove 301.

The latch 276 is shaped like a plate, and an engagement projection 245 is integrally formed to the end portion 305 taken in the longitudinal direction. The engagement projection 245 is warped toward one side taken in the thickness direction. An engagement surface 247 of the engagement projection 245 and the outer peripheral surface including the insertion guiding surface 250 are formed in the shape of an arc. The latch 276 is fit into a guiding groove 301, in such a manner that the engagement projection 245 is warped toward the opening portion of the bobbin case 231. In this condition, the both side portions 306*a*, 306*b* taken in the width direction which are perpendicular to the longitudinal direction of the latch 276 are locked by projecting portions 303*a*, 303*b*. The latch 276 is disposed for free movement in a projecting direction B11 in which the engagement projection 245 projects outwardly in the radius direction and an opposite retracting direction B12 in which the engagement projection retracts inwardly in the radius direction along the guiding groove 301, while displacement of the bobbin case 231 in the axial line direction is prevented.

Further, with respect to the latch 276, a spring receiving portion 307 which projects outwardly in the width direction is disposed to the side portion 306*a* of the width direction which is toward the end portion 305 taken in the longitudinal direction. In addition, in the end wall 261, at a position toward the other end portion taken in the longitudinal direction of the guiding groove 301, along the side portion 302*a* of the width direction, a spring housing recess 308 is formed to house a compressed coil spring 309. Fit in the guiding groove 301 and under spring force of the compressed coil spring 309 in the projecting direction B11, the latch 276 causes the engagement projection 245 to elastically project outwardly in the radius direction from the outer peripheral surface 244 of the peripheral wall 260.

Still further, an engagement flap through hole 311 which penetrates in the thickness direction is formed in the latch 276, at a position near the other end portion 310 of the longitudinal direction. The engagement flap through hole 311 includes a wide width portion 311*a* which is disposed toward the end portion 305 taken in the longitudinal direction of the latch 276 and a narrow width portion 311*b* which is disposed toward the other end portion 310 of the longitudinal direction of the latch 276.

The manipulation flap 278 includes an engagement flap 313 at one end portion 312 taken in the longitudinal direction. The engagement flap 313 is warped toward one side in the thickness direction and includes an extending portion 313*a* having a narrow width and an engagement portion 313*b* of a wide width at the tip of the engagement flap 313. The width of the extending portion 313*a* of the engagement flap 313 is selected as a smaller width than the width of the narrow width portion 311*b* of the engagement flap through hole 311 of the latch 276, while the width of the engagement portion 313*b* of the engagement flap 313 is selected as a wider width than the width of narrow width portion 311*b* of the engagement flap through hole 311 of the latch 276 but as a smaller width than the width of the wide portion 311*a*. The width of the extending portion 313*a* of the engagement flap 313 is selected as a narrower width than the width of the narrow width portion 304*a* of the engagement hole 304 of the end wall 261. The width of the engagement portion 313*b* of the engagement flap 113 is selected as a wider width than the width of the narrow width portion 304*a* of the engagement hole 304 of the end wall 261 but as a smaller width than the width of the wide width portion 304*b* of the engagement hole 304.

With respect to such an engagement flap 313, the engagement portion 313*b* at the one end portion 312 taken in the longitudinal direction passes through the engagement flap through hole 311 of the latch 276 and is inserted in the engagement hole 304 of the end wall 261. Thus, in a condition that the engagement flap 313 inserted, when there is no external force applied, with respect to the engagement flap 313, the engagement position 313*b* is fit in the wide width portion 304*b* of the engagement hole 304, so that the extending portion 313*a* is inserted in the narrow width portion 311*b* of the engagement flap through hole 311. With respect to the latch 276, the engagement portion 313*b* abuts with the extending portion 313*a* of the engagement flap 313 of the manipulation flap 278 which is locked by a peripheral portion 314 of the engagement hole 304, so that displacement in the projecting direction B11 against the spring force of the compressed coil spring 309 is prevented. At the same time, the engagement portion 313*b* of the engagement flap 313 abuts with the both peripheral portions of the narrow width portion 311*b* of the engagement flap through hole 311 of the latch 276, and therefore, the manipulation flap 278 is prevented from falling through. Thus, prevented from falling through toward the both sides, the manipulation flap 278, as it is superimposed over the latch 276, is linked to the bobbin case body 279 and the latch 276 for free angular displacement about the center of angular displacement which is the end portion of the engagement portion 313*b* of the engagement flap 313 on the one end portion 312 side of the longitudinal direction, in a raising direction C11 in which the other end portion 315 moves away from the latch 276 and in a dropping direction C12 in which the other end portion 315 moves closer to the latch 276.

When there is no external force acting upon the bobbin case 231, since the latch 276 is under the spring force in the projecting direction B11, while pressing the extending portion 313*a* of the engagement flap 313 of the manipulation flap 278, the latch 276 causes the engagement projection 245 to elastically project from the outer peripheral surface 244 of the peripheral wall 260. At this stage, the manipulation flap 278 is dropped down along the latch 276. As the manipulation flap 278 is operated to displace in angle in the raising direction C11 from this condition, angular displacement of the manipulation flap 278 takes place in the raising direction C11 about the center of angular displacement which is the end portion of the engagement portion 313*b* of the engagement flap 313 on the one end portion 312 side of the longitudinal direction, and therefore, the extending portion 313*a* of the engagement flap 313 is displaced in the same direction as the retracting direction B12 and the latch 276 is accordingly displaced in the retracting direction B12. At this stage, the notch 300 is formed from the peripheral wall 260 to the end wall 261, and hence, the engagement projection 245 is allowed to retract. Further, with respect to the engagement flap 313, angular displacement of the extending portion 313*a* is possible by means of the narrow width portion 304*a* of the engagement hole 304.

Thus, the engagement recess 243 which is recessed in an outward radius direction from the inner peripheral surface 242 is formed in the bobbin case holder 230, and the engagement projection 245 which elastically projects in the outward radius direction from the outer peripheral surface 244 is formed in the bobbin case 231. With the bobbin case 231 mounted in the bobbin case holder 230, the engagement projection 245 is fit in the engagement recess 243. The engagement surface 247 is formed in the engagement projection 245. With the bobbin case 231 mounted in the bobbin case holder 230, the engagement surface 247 elastically abuts the engagement portion 246 of the opening peripheral portion of the engagement recess 243 of the open end side of the bobbin case holder. The elastic force makes it possible to press the bobbin case 231 in the diametral line direction thereof and in the direction toward the bottom wall 253 of the bobbin case holder.

As shown in FIG. 12, the outer diameter of the flange 297*a* which is disposed on the bottom wall 253 side of the bobbin case holder 230 is approximately the same as the outer diameter of the peripheral wall 260 of the bobbin case 231 but is a little smaller than the inner diameter of the peripheral wall 252 of the bobbin case holder 230. Further, the outer diameter of the other flange 297b which is disposed on the open end side of the bobbin case holder 230 is smaller than the inner diameter of the peripheral wall 260 of the bobbin case 231. An outermost peripheral portion 321 of the other flange 297*b* includes a first gap 322 having a distance T11 through which the bobbin thread 262 can idly pass through, against the inner peripheral surface of the peripheral wall 260. In addition, the other flange 297*b* is formed at an angle $\alpha 1$ in a direction closer to the another flange 297*a* with a distance outwardly in the radius direction. The angle $\alpha 1$ is selected as 3 to 15 degrees, for example. The length of the bobbin 240 at the center in the axial line direction is shorter than a distance between an inner surface 253*a* of the bottom wall 253 of the bobbin case holder 230 which is faced with the open end and an inner surface 261*a* of the end wall 261 of the bobbin case 231 which is faced with the bottom wall 253, whereby a second gap 323 is created between the end wall 261 of the bobbin case 231 and the other flange 297*b* of the bobbin 240.

Intersecting portions 324*a*, 324*b* of the flanges 297*a*, 297*b* and the winding drum 298 are formed in an arc shape in cross section taken along one plane which includes the axial line of the bobbin 240. Further, as described earlier, the flange 297*b* of the open end side is inclined in the direction closer to the flange 297*a* of the bottom wall 253 side with a distance outwardly in the radius direction, and therefore, a bobbin winding space 325 in which the bobbin thread 262 is wound up is U-shaped in cross section, so that the amount of winding the bobbin thread 262 in a region close to the winding drum 298 is reduced. The reason is to prevent that when the diameter of the bobbin thread 262 which is wound around the winding drum 298 between the flanges 297*a*, 297*b* decreases, the speed at which the bobbin thread 262 is unwound while rotating on the outermost peripheral portion 321 of the flange 297*b* of the open end side becomes extremely large as the bobbin thread 262 is pulled out and undesirably large tangling is applied to the bobbin thread 262. The outermost peripheral portion 321 of the flange 297*b* of the open end side may be formed in a shape which is smoothly warped as a convex outwardly in the radius direction in cross section as shown in FIG. 12, so as to make it possible to smoothly move the bobbin thread 262 in the direction in which the bobbin thread 262 is pulled out.

The bobbin thread leading hole 270 is formed in the end wall 261 of the bobbin case 231, the first through hole 275 is formed in the latch 276, and the second through hole 277 is formed in the manipulation flap 278, as described earlier. A gap for passing the bobbin thread 262 through is formed, including the first gap 322, the second gap 323, the bobbin thread leading hole 270, the first through hole 275 and the second through hole 277. A peripheral portion 326 of the bobbin thread leading hole 270 of the end wall 261 which is opposed to the inner surface 261*a* is warped round, and rotates as the bobbin thread 262 is pulled out when the bobbin thread 262 is spun between the peripheral portion 326 and the outermost peripheral portion 321 of the flange 297*b* of the open end side. As this occurs, since the peripheral portion 326 is warped round, there is no possibility that the bobbin thread 262 will be damaged by a corner portion. Hence, large friction force does not work in the axial line direction of the bobbin thread 262, i.e., the direction in which the bobbin thread 262 is pulled out, and a slide resistance at the inner peripheral surface of the bobbin thread leading hole 270 is small, which in turn prevents the tension force of the bobbin thread 262 from changing undesirably.

The outermost peripheral portion of the other flange 297*a*, which is disposed on the bottom wall 253 of the bobbin 240, and a portion around the same is elastically pressed by an open end portion 327 of the peripheral wall 260 of the bobbin case which is mounted in the bobbin case holder 230 in the direction closer to the bottom wall 253 and is held within the bobbin case holder in this condition, and therefore, even though the bobbin thread 262 is pulled out, the bobbin 240 rotates the bobbin thread 262 about the axial line of the bobbin 240 so that the bobbin thread 262 is pulled out while rotating on the outermost peripheral portion of the other flange 297*b* of the open end side. Hence, unlike in the conventional technique, there is no possibility that the bobbin thread 262 will be excessively loosened within the bobbin case 231 due to inertia which is created as the bobbin 240 rotates, and therefore, it is possible to smoothly supply the bobbin thread 262 and to prevent the tension force of the bobbin thread 262 from changing during sewing. This eliminates a variation in the tension force of the bobbin thread 262, and consequently, nonuniform fastening of the thread is prevented and the quality of sewing is improved.

Figure 16:
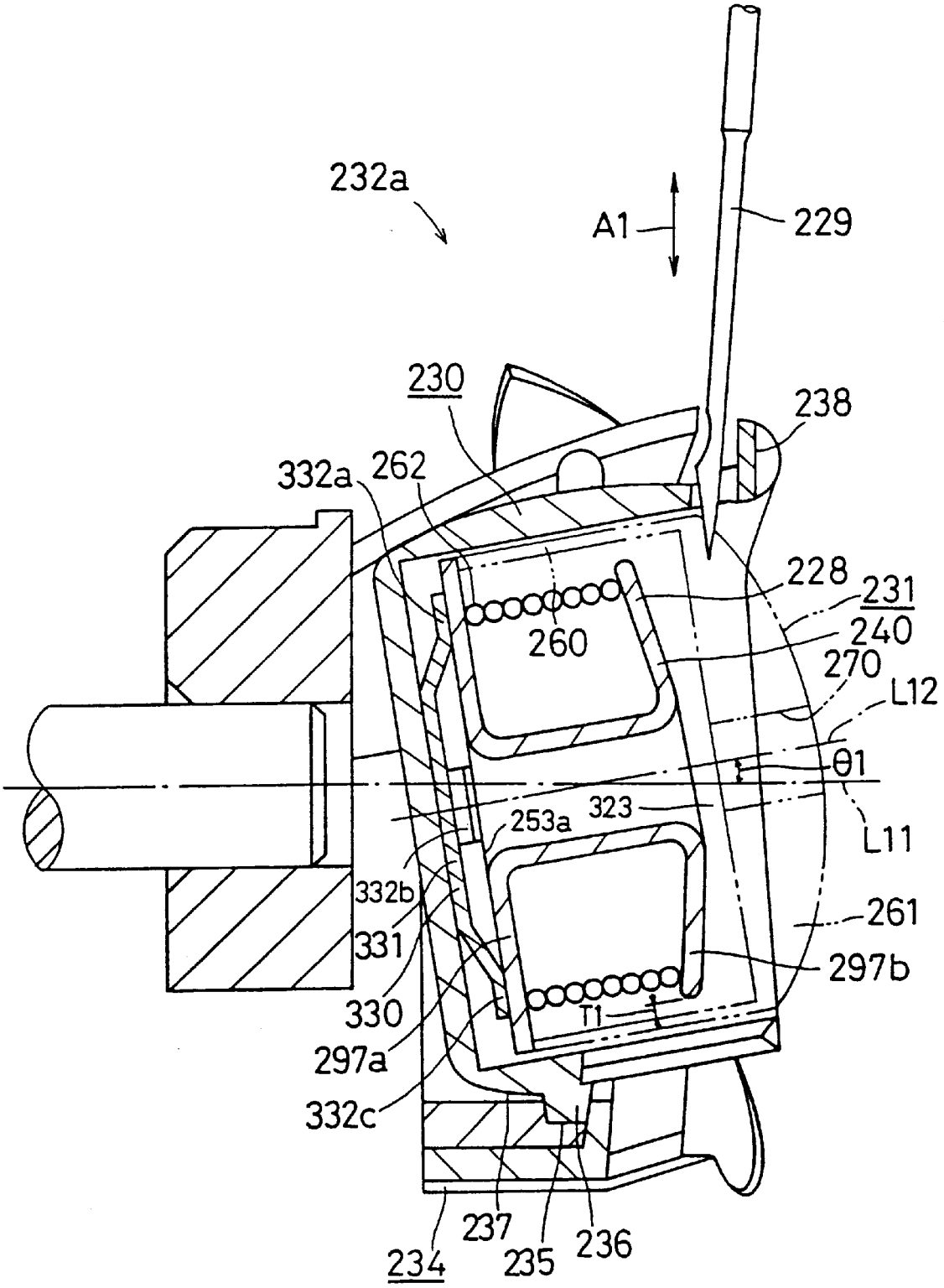
FIG. 16 is a vertical cross sectional view of a horizontal axis full rotary hook 32*a* according to a further preferred embodiment of the invention.

FIG. 16 is a vertical cross sectional view of a horizontal axis full rotary hook 32*a* according to other preferred embodiment of the invention. Identical reference symbols will be assigned to corresponding portions to FIGS. 11 to 15. In this preferred embodiment, a blade spring 330 which has the same structure with the blade spring 130 as that shown in FIG. 9 is fixed by welding, for example, to the inner surface 253*a* of the bottom wall 253 of the bobbin case holder 230 which is faced with the open end. The blade spring 330 includes abase portion 331 of a ring-shaped thin plate which is fixed in parallel to the inner surface 253*a* of the bottom wall 253, and a plurality of pressing flaps 332*a* to 332*d* (four pressing flaps in this preferred embodiment) which extend at equal intervals in the circumferential direction from an outer peripheral portion of the base portion 331 outwardly in the radius direction and which extend beyond one surface of the base portion 331 toward one side of the axial direction. Such a blade spring 330 elastically presses the flange 297*a* of the bottom wall 253 side of the bobbin 240, toward the open end side. In this condition, since the bobbin case 231 is pressed by the spring force of the compressed coil spring 309 of the latch 276 in the direction closer to the bottom wall 253, i.e., toward the left-hand side in FIG. 16, the outer peripheral portion of the flange 297*a* is elastically pressed by the pressing flaps 332*a* to 332*d* of the blade spring 330, as it is supported on the open end portion 327 of the peripheral wall 260 of the bobbin case 231. Hence, the bobbin 240 can displace in direction closer to the bottom wall 253, as it is elastically pressed by the blade spring 330. Therefore, the spring force of the compressed coil spring 309 does not have to be unnecessarily large spring force for the purpose of pressing the bobbin 240 by means of the bobbin case 231, but rather may be large enough to prevent the bobbin case 231 from falling from the bobbin case holder 230. Hence, a known compressed coil spring 309 may be used. Further, since the engagement projection 245 of the latch 276 abuts the engagement portion 246 without fail, it is not necessary to adjust the quantity of the engagement portion 246 projecting inwardly or outwardly in the radius direction and depending on the thickness of the flange 297*a,* which saves troubles during production.

As a further preferred embodiment of the invention, instead of the blade spring 330 which is shown in FIG. 14, the conical coil spring 135 described earlier as that shown in FIG. 10 may be used, or alternatively, a spring having other structure may be appropriately selected and used.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A rotary hook for sewing machines comprising:

a bobbin case holder, a bobbin case detachably attached to the bobbin case holder, and a bobbin held in the bobbin case holder by elastically pressing a flange of the bobbin disposed on a bottom portion side of the bobbin case holder, against a peripheral wall of the bobbin case, wherein a gap through which a bobbin thread wound around the bobbin passes is provided between an outermost portion of a flange of the bobbin disposed on an open end side of the bobbin case holder and an inner peripheral surface of the peripheral wall of the bobbin case and between the flange of the bobbin disposed on the open end side of the bobbin case holder and an inner surface of an end wall of the bobbin case, and a bobbin thread leading hole linked to the gap is formed in the end wall of the bobbin case.

2. The rotary hook for sewing machines of claim 1, wherein a spring for elastically pressing the bobbin within the bobbin case holder toward the open end side of the bobbin case holder is disposed at a bottom portion of the bobbin case holder.

3. The rotary hook for sewing machines of claim 1, wherein an axial line of the bobbin case holder is inclined with respect to a rotation axial line of the hook body, in a direction in which an idle end portion of the bobbin which is closest to a needle is farther in distance from a path in which the needle moves.

4. The rotary hook for sewing machines of claim 2, wherein an axial line of the bobbin case holder is inclined with respect to a rotation axial line of the hook body, in a direction in which an idle end portion of the bobbin which is closest to a needle is farther in distance from a path in which the needle moves.

* * * * *